US007047855B2

(12) United States Patent
Beccari

(10) Patent No.: US 7,047,855 B2
(45) Date of Patent: May 23, 2006

(54) APPARATUS FOR CUTTING PIECES OF MATERIAL INTO APPROPRIATE SHAPED PORTIONS

(75) Inventor: Cesare Beccari, Bologna (IT)

(73) Assignee: Bierrebi S.p.A., Zola Predosa (IT)

( * ) Notice: Subject to any disclaimer, the term of this patent is extended or adjusted under 35 U.S.C. 154(b) by 0 days.

(21) Appl. No.: 10/148,581

(22) PCT Filed: Nov. 30, 2000

(86) PCT No.: PCT/IB00/01781

§ 371 (c)(1),
(2), (4) Date: Jun. 3, 2002

(87) PCT Pub. No.: WO01/39941

PCT Pub. Date: Jun. 7, 2001

(65) Prior Publication Data

US 2002/0178887 A1 Dec. 5, 2002

(30) Foreign Application Priority Data

Dec. 3, 1999 (IT) ..... BO99A0662

(51) Int. Cl.
*B26D 1/60* (2006.01)

(52) U.S. Cl. ..... 83/227; 83/276; 83/940

(58) Field of Classification Search ..... 83/940, 83/941, 497, 450, 455, 676
See application file for complete search history.

(56) References Cited

U.S. PATENT DOCUMENTS

| | | | | |
|---|---|---|---|---|
| 1,755,813 | A | | 9/1930 | Colby |
| 2,538,972 | A | | 1/1951 | Magnani |
| 3,668,956 | A | | 6/1972 | Whipple et al. |
| 3,693,489 | A | * | 9/1972 | Pearl ..... 83/374 |
| 4,318,537 | A | * | 3/1982 | Dorman et al. ..... 269/302.1 |
| 4,358,975 | A | * | 11/1982 | Higgins ..... 83/56 |
| 4,362,077 | A | * | 12/1982 | Gerber ..... 83/453 |
| 4,373,412 | A | | 2/1983 | Gerber et al. |
| 4,382,728 | A | * | 5/1983 | Anderson et al. ..... 409/137 |
| 4,444,078 | A | * | 4/1984 | Pearl ..... 83/374 |
| 4,643,061 | A | * | 2/1987 | Gerber ..... 83/174.1 |
| 4,916,992 | A | | 4/1990 | Nasu |
| 4,972,745 | A | | 11/1990 | Bruder et al. |
| 5,061,331 | A | | 10/1991 | Gute |
| 5,100,115 | A | * | 3/1992 | Schorn ..... 269/302.1 |
| 5,101,747 | A | | 4/1992 | Gerber |
| 5,350,898 | A | | 9/1994 | Higashiguchi |
| 5,663,885 | A | | 9/1997 | Stahl |
| 6,308,602 | B1 | * | 10/2001 | Gerber ..... 83/76.6 |
| 6,543,439 | B1 | * | 4/2003 | Kollner |

FOREIGN PATENT DOCUMENTS

| | | |
|---|---|---|
| DE | 20 46 339 | 4/1971 |
| DE | 36 09 925 | 10/1986 |
| DE | 94 01 188 | 5/1994 |
| DE | 295 20 384 | 5/1997 |
| GB | 2 297 682 | 8/1996 |

* cited by examiner

*Primary Examiner*—Kenneth E. Peterson
(74) *Attorney, Agent, or Firm*—Young & Thompson

(57) ABSTRACT

An apparatus for cutting a material having prevalently two-dimensional extension into appropriately shaped portions, in particular for cutting a fabric or the like into shaped portions for the manufacture of clothing items or other items, comprising a support frame (12), means (22) for supporting said material (16), means for supporting cutting means (20). Said cutting means (20) are movable relative to said material (16) according to trajectories suited for effecting longitudinal, transverse, or otherwise oriented cuts into said material (16).

89 Claims, 17 Drawing Sheets

APPARATUS FOR CUTTING PIECES OF MATERIAL INTO APPROPRIATE SHAPED PORTIONS

TECHNICAL FIELD

The present invention relates to an apparatus for cutting a material having prevalently two-dimensional extension into appropriately shaped portions.

In particular for cutting a fabric or the like into portions shaped for the manufacture of clothing items or the like.

BACKGROUND ART

According to the prior art, apparatuses for cutting swathes or pieces of fabric, or similar material, in appropriately shaped portions, in particular for the manufacture of clothes or other clothing items, comprise a single area for the cutting of said pieces, in correspondence whereto the cutting into shaped portions is effected by means of a hack sawing machine, suitably actuated along the piece.

In such known machines, said material is supported on a sort of yielding support plane, which is defined by means of appropriate supporting bristles, which allow said hack sawing machine to extend beyond the plane defined by the two-dimensional piece, inserting themselves between the aforementioned supporting bristles.

The use of such a yielding support leads to a non perfectly horizontal disposition of the material and to a retention thereof that is not effective in every point, with consequent cutting inaccuracies on the part of the hack sawing machine.

In these known machines, the pieces, once cut, are manually removed from the cutting area. To obtain an acceptable productivity of such machines, work is conducted simultaneously on a certain quantity of pieces (a few tens, for instance 40–50 pieces), of rectangular or square shape, which are stacked onto the bristle support and held thereon by means of a vacuum opportunely applied on the side of said bristle support. Once the pieces are cut, they are then collectively and manually removed by assigned personnel. To assure a removal intervention that is as rapid as possible, however, an excessive number of personnel is employed, which personnel cyclically perform appropriate manual operations for the removal of the cut pieces and then remain idle between a removal and the next. The cost for such excessive manpower negatively influences the cost of production of the item. Moreover, the manual removal operation is slow and it also slows down the start of a subsequent cutting phase.

Also elaborate, slow and costly is the preparation of the stack of pieces, which entails the disposition of said pieces one on top of the other, alternated with paper sheets whose function is to stiffen and support the pack or plurality of superposed pieces of fabric to be cut. To the pieces is also superposed a plastic film that allows the aspiration and retention of the pack on the bristle carpet.

The use of such a vacuum retention system for the pieces also leads to the construction of complex, costly machines which absorb a considerable quantity of energy.

The aspiration system for the pieces, moreover, is noisy and gives off heat to the space housing the cutting machine, creating corresponding temperature control problems.

Moreover, such a manner of operating with superposed pieces necessarily forces to cut pieces in portions that are all identical to manufacture clothes which are necessarily of the same size. Because the stack of pieces to be cut is sustained on a yielding (bristle) support, the drawback of a differentiated cut from piece to piece arises, and is particularly accentuated between the pieces lying at the top and those that are at the bottom of the stack to be cut. Thus, the drawback emerges of clothes produced from different pieces which, although they should be of the same size, do not at all have the same geometric dimensions.

Moreover, in such known machines, because pieces are used having predefined quadrangular shape which are then stacked and cut collectively, a certain number of unusable scrap portions are necessarily present in each piece, in particular in correspondence with the peripheral areas of said pieces. This material cannot be used in any way at all and hence it must be scrapped, leading to material wastage and costs for manufacturing companies.

According to another disadvantageous aspect of prior art machines, mutually adjacent fabric portions are cut according to cutting lines that are close to, but distinct from, one other. The fabric present between said close cutting lines becomes scrap material, thereby considerably contributing to the excessive production of scrap material in said prior art machines.

In some known machines, the use of a hack saw forces to start cutting the pieces from an edge thereof. The cut of the piece into related portion cannot be planned freely but must take into account this constraint relating to the starting point of the cut. Other known machines, of a more complex kind, instead make use of an appropriate drilling head, which allows to start the cut in any point inside the surface of the pieces, which drilling head is added to the aforementioned hack saw, making the corresponding machine excessively complex.

DISCLOSURE OF INVENTION

According to an advantageous aspect of the present invention, as described in claim 1, an apparatus is provided for cutting a material having prevalently two-dimensional extension into appropriately shaped portions, in particular for cutting a fabric or the like into shaped portions for the manufacture of clothing items or other items, comprising a support frame, means for supporting said material, means for supporting cutting means, wherein said cutting means and said material are movable relative to each other according to trajectories suitable for effecting cuts in said material, wherein said cutting means comprise revolving cutting means, and wherein means for the angular orientation of said revolving cutting means are provided.

By using said revolving cutting means, it is possible to start the cut from any point of the piece, even from a point inside the surface thereof. Hence, it is not necessary to start the cut from an edge of the piece, nor to use additional cutting or penetrating organs, as was the case in prior art machines. The present machine therefore is extremely simple and flexible in use, allowing for a design free of constraints for the shaped cut portions of the piece.

According to an additional advantageous aspect, said revolving cutting means operate preferably in combination with a rigid support surface, thereby obviating the inaccurate cuts obtained in the prior art because of the need to use a yielding support for said material.

According to another aspect, said material to be cut is preferably in the form of a single layer of material. In this case, unlike prior art systems, it is possible to obtain extremely precise, substantially identical cuts for each piece or section of material that is cut.

According to another aspect, said apparatus comprises means able to hold still the material to be cut in correspondence to the cutting means. According to an advantageous embodiment, said means for retaining the material in correspondence with the cutting means comprise roller means for contacting and pressing on said material.

In this way it is possible to eliminate the use of the known systems for retaining the pieces by vacuum. Also avoided is the need to prepare appropriate stacks with upper sheet of plastic film for retaining the stack of pieces on the support surface.

In accordance with a further aspect, said means for supporting said material define sliding means able to allow the translation of said material.

In this way it is possible easily to move said material, for instance in longitudinal feeding, to place it in the appropriate position.

According to another aspect, the present apparatus also comprises appropriate means for advancing the material. According to an advantageous embodiment, said means for advancing the material are such as to advance said material by a predefined segment equal to the distance between a cutting area upstream and an area downstream of said cutting area. This allows rapidly to free said cutting area in view of a further cutting of a subsequent piece or section of material.

In practice, unlike known machines, with the present apparatus it is possible to render substantially independent the cutting phase from the removal phase, allowing to maximise the speed of the transition phases from a cutting phase to the next cutting phase.

Moreover, said means for advancing the material comprise means for retaining the material and means for advancing said retaining means, wherein said retaining means comprise roller means engaged on the material and motionless relative thereto to thrust the material itself against the opposing support means. relative whereto said material is made to slide. In this case, a considerable structural simplification is obtained of the means that engage the material for retaining the material in the cutting phase and retaining the material in the advancing phase.

According to another aspect of the present apparatus, said material is fed in the form of a continuous ribbon from which are separated successive pieces within each of which are provided said useful shaped portions, and the transverse lines delimiting in said ribbon a single piece of material to be cut have an appropriately shaped conformation.

It is thus possible to obtain useful peripheral portions of material in adjacent and successive pieces. In this way, considerable quantities of tissues can be saved with respect to prior art machines wherein pieces of quadrangular shape are always cut and wherein, in correspondence with the transverse edges, a great quantity of unusable scrap portions are obtained.

Moreover, a simplified programming of the areas of each piece to be cut is possible, thanks to the elimination of the constraint of having transverse lines necessarily in the form of a straight line, as was instead the case according to the prior art.

According to a further aspect, appropriate means for weakening the material in correspondence with the contact between the cutting means and the material to be cut are provided. A more effective and accurate cut is thereby obtained, along with the ability to maximise the speed of the cutting operation.

In accordance with another aspect of the present innovative apparatus, the use of a plurality of cutting units in correspondence with said cutting area is also provided, each cutting unit being for cutting a respective area of said material. In this way, the cutting of a single piece is particularly rapid.

In accordance with yet another aspect, means for stocking the material are employed on said frame of the apparatus, so that said material can also be suitably stacked in view of its subsequent removal. The volume to be dedicated to the execution of the removal and storage of the cut pieces inside industrial spaces is thereby removed.

Preferred and advantageous embodiments of the present apparatus are also described in the claims.

BRIEF DESCRIPTION OF THE DRAWINGS

The various innovative aspects of the present apparatus shall become more readily apparent from the detailed description that follows, made with reference to the accompanying drawings, which represent an embodiment provided purely by way of non limiting example, in which.

DESCRIPTION OF THE ILLUSTRATIVE EMBODIMENTS

Figure 1A:
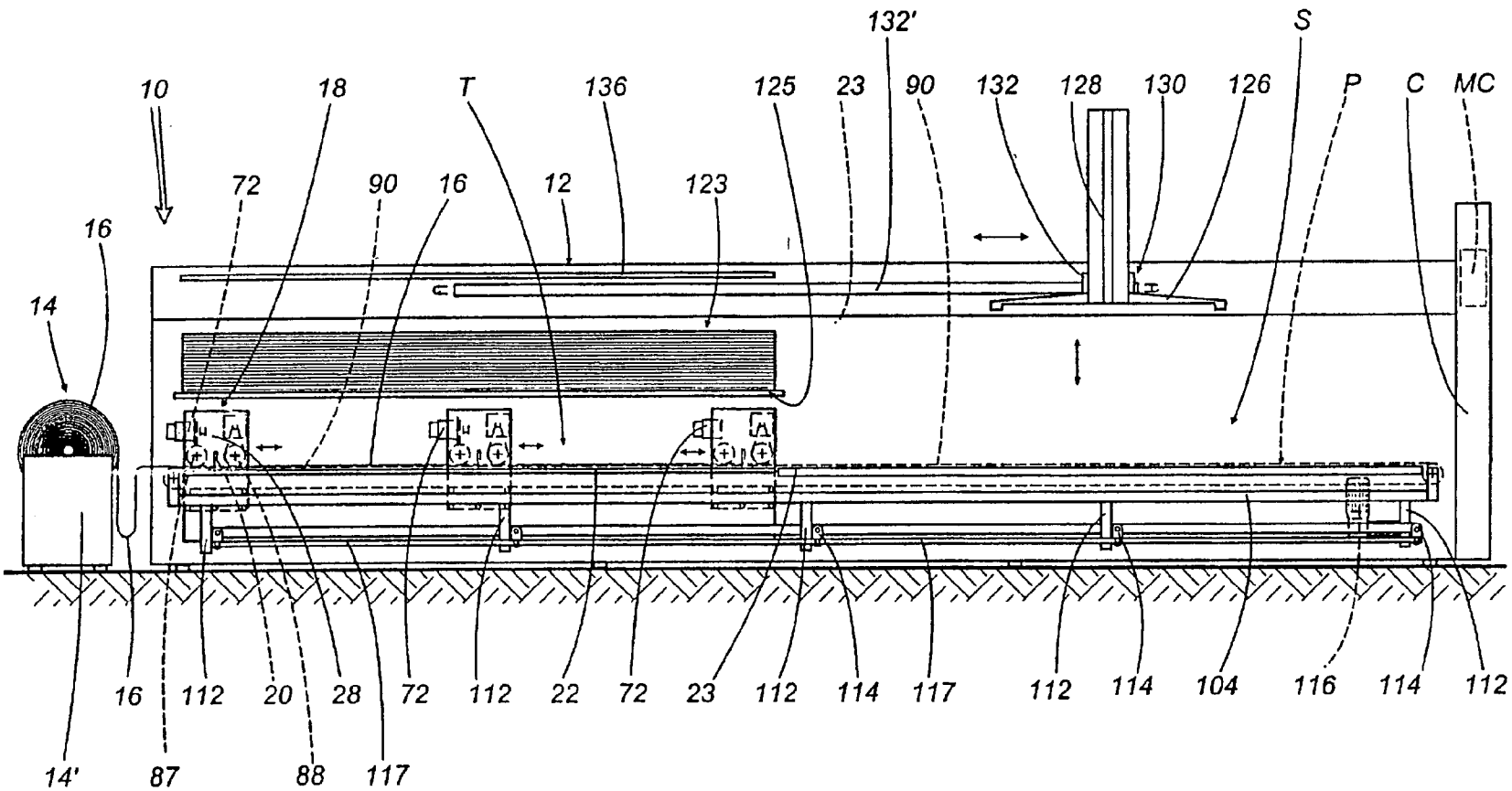
FIG. 1A shows a lateral schematic view of a preferred embodiment of the present apparatus, with reference to a first operative condition of the apparatus.
Figure 2:
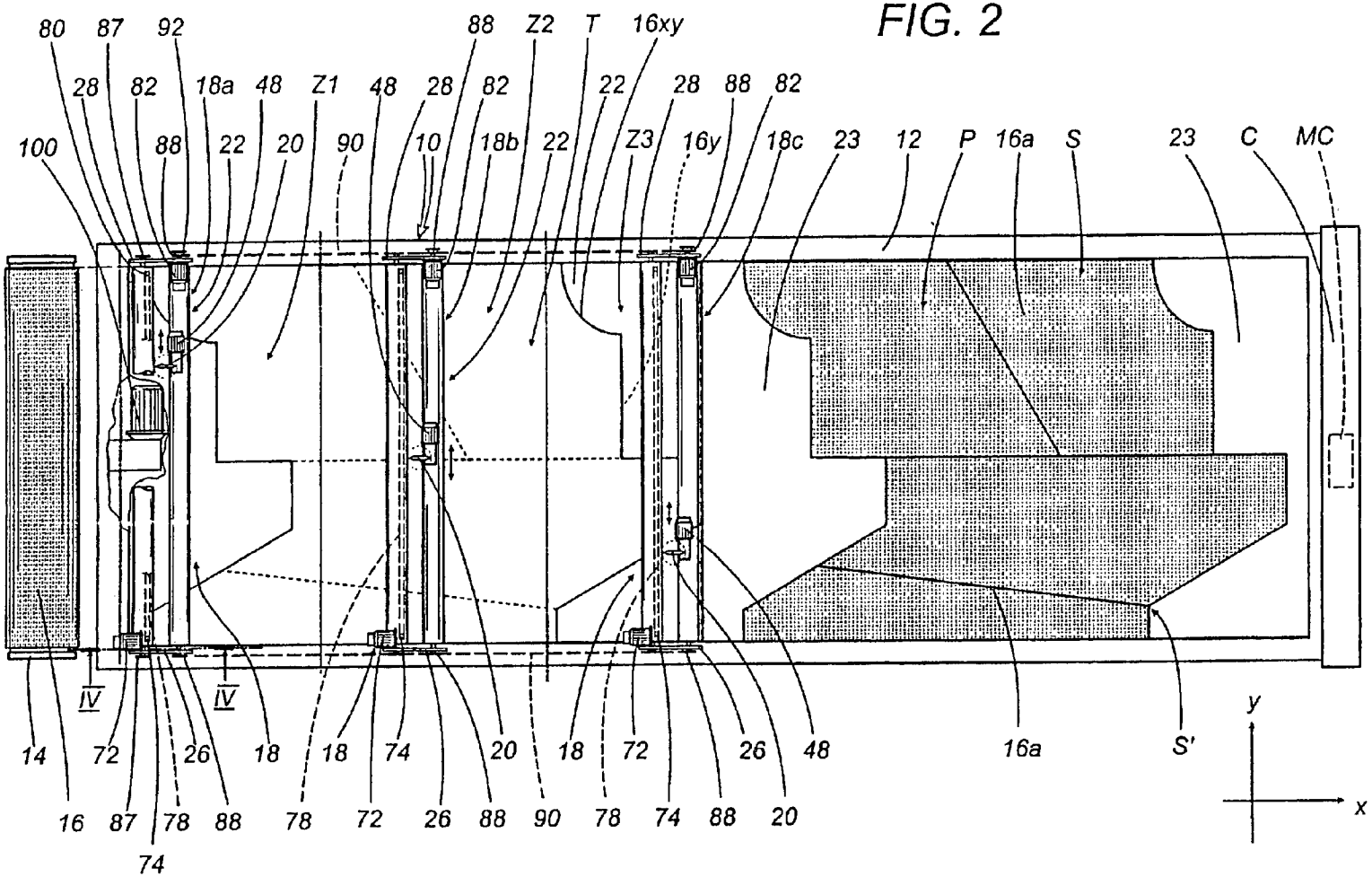
FIG. 2 shows a schematic top plan view of the preferred embodiment of the present apparatus.
Figure 3:
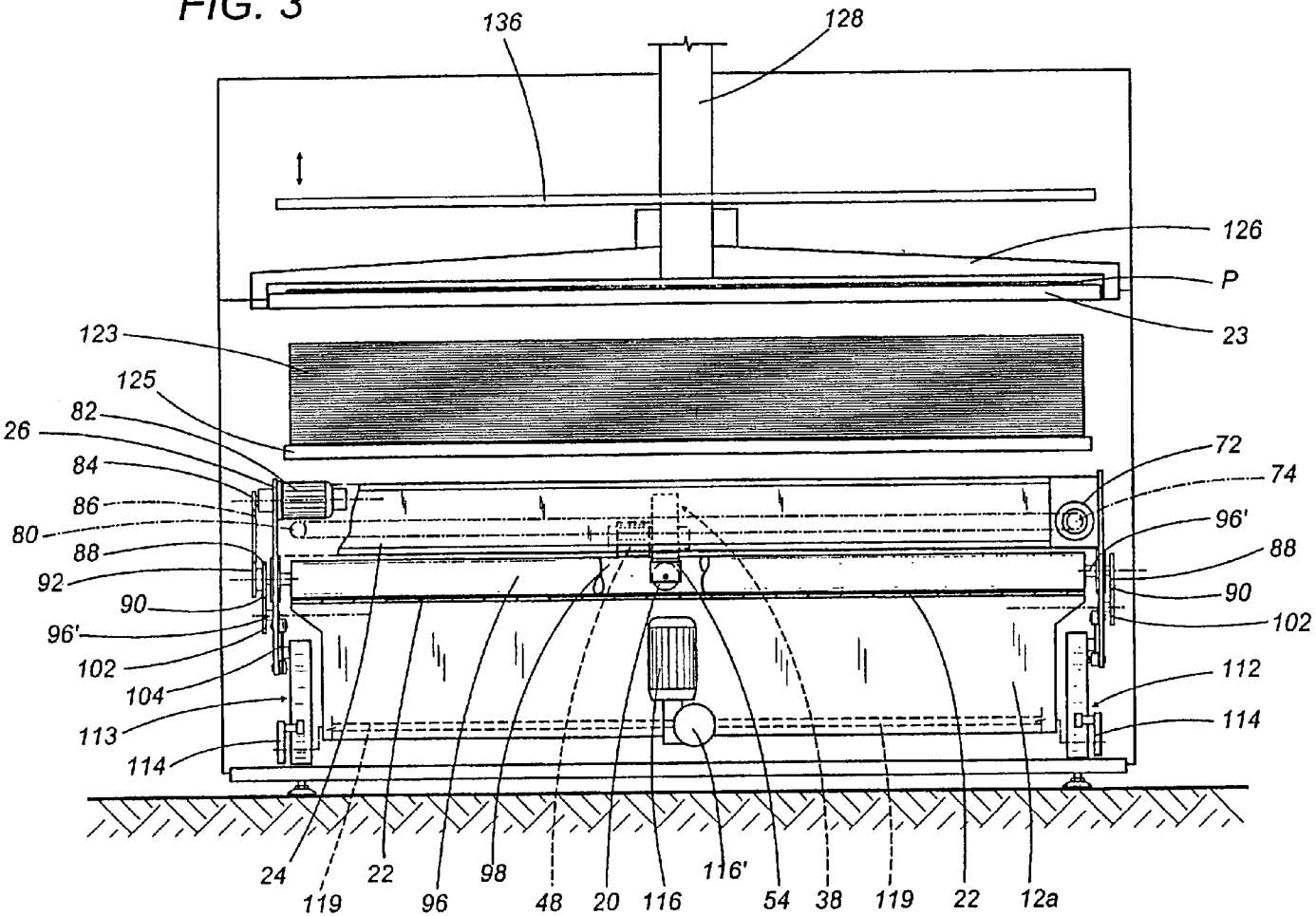
FIG. 3 is a transverse schematic view of the rear part of the apparatus, showing in particular the cutting area of the preferred embodiment of the present apparatus.

With particular reference to FIGS. 1A, 2 and 3 of the accompanying drawings, it can be noted that a first preferred embodiment 10 of the present apparatus for cutting a fabric or the like into shaped portions for the manufacture of clothing items or other items comprises a frame 12 for supporting a plurality of units 18*a*, 18*b*, 18*c* for cutting the fabric material, which are longitudinally distanced from each other and are provided with appropriate means 20 for cutting the material.

As shall become more readily apparent farther on, the present apparatus employs appropriate electronic control means, in particular a computer indicated schematically and marked with the reference MC in the figures, which means are programmable to command, among other items, the execution of cuts in predefined and desired portions of said longitudinal piece.

The cutting units, as shown, are in particular in the form of three distinct and independent cutting units 18*a*, 18*b*, 18*c*, which are destined to operate on a respective area of said material in the cutting zone, which, in this specific case, is constituted by a respective longitudinal portion Z1, Z2, Z3 of said piece of material to be cut. Obviously, the longitudinal extension of said areas of influence of the individual cutting units could also be different from the one shown, for instance, advantageously, the longitudinal lengths of said areas could be different and programmed at will, according to the cutting lines to be provided in each individual zone for the purpose, for example, of having cutting units that stop operating their respective cuts nearly in the same instance or within short time intervals one from the other. The longitudinal movement that allows said units 18*a*, 18*b*, 18*c* to cut the materials is schematically indicated with the arrows L in FIG. 1A.

The zone of influence of the individual cutting units, in any case, need not be constituted by a longitudinal zone of the piece. The zone of influence is appropriately predefined thanks to suitable electronic processing means and can be shaped in any way, in particular to obtain the maximum cutting velocity of the piece or section of fabric, taking into account, among other factors, the length and disposition of the cutting lines to be executed and the mutual motion between the various cutting units.

The material to be cut into shaped portions is unwound in the form of a continuous ribbon or band 16 from a spool 14 supported on appropriate means 14' (see FIG. 1A) and is fed forward, as shall become clearer farther on, in a discontinuous manner, alternating advancing phases and stopped phases, during which said material is cut into shaped portions.

In practice, the continuous ribbon is progressively cut into pieces P, of predefined length, within which are obtained the aforesaid appropriately shaped portions 16*a* (see FIG. 2).

Figure 7:
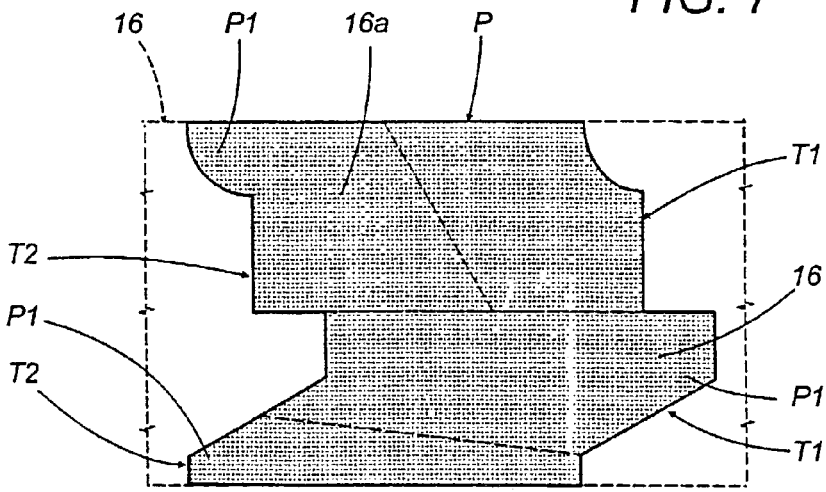
FIG. 7 shows an example of an advantageous conformation of pieces separated from a single continuous ribbon, as can be obtained by using the present embodiment of apparatus.

As FIG. 7 schematically shows, according to an advantageous aspect of the present invention, the pieces P can be delimited or obtained from transverse lines T1 and T2, executed by said cutting means, which, instead of being rectilinear as is the case for the pieces used in known machines, are appropriately shaped and allow to optimise material usage.

For instance, it is possible to cause the transverse cutting lines to be appropriately shaped to define portions P1 projecting towards or receding into the successive piece and to obtain, in correspondence with the transverse edges of each piece, a corresponding useful portion 16*a*. In this way, the production of unusable portions to be eliminated in correspondence with said transverse edges of the piece is eliminated or minimised, in comparison to the prior art.

The conformations of the transverse cuts T1, T2 can be the same for all pieces or strips P, or can be varied appropriately from a piece to the other to adapt them to the specific dimensions and shapes of the useful portions planned in each piece.

The aforementioned electronic processing means can define transverse cutting lines shaped in any way, depending on specific needs.

It is also possible to provide for the cut of portions destined to a single article on a single piece and not necessarily to provide a large quantity of articles as in the prior art, where cuts had to be effected on stacked pieces. With the present apparatus, therefore, materials destined to the manufacture of even a very small quantity of articles can be produced, without penalising working times.

Said cutting means and said material are movable relative to each other according to appropriate trajectories for obtaining longitudinal cuts 16*x*, transverse cuts 16*y*, or cuts oriented in any way in said material 16, in particular arched or oblique cuts 16*xy*.

According to a particularly advantageous aspect, the cutting means supported by the single unit 18*a*, 18*b*, 18*c* are in the form of revolving cutting means, in particular in the form of a circular cutting blade 20, which is rotated angularly, by appropriate orienting means 42, 44, relative to the material to be cut 16, to orient it in the direction of the specific trajectory of the cut to be effected in the material.

Figure 4:
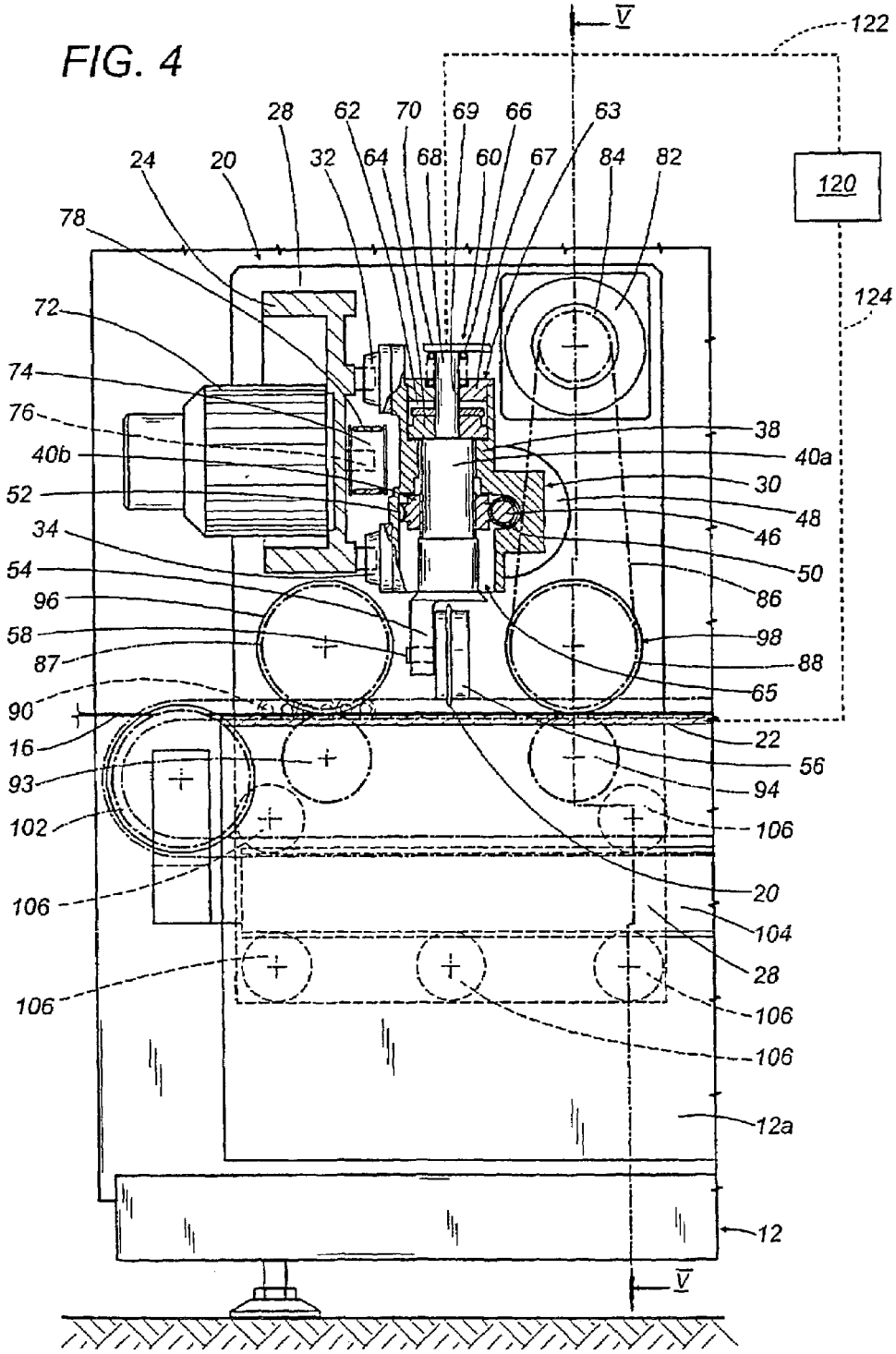
FIG. 4 shows a schematic cross section view relating to a single cutting unit of the preferred embodiment of the present apparatus, taken according to the line IV—IV of FIG. 2 and in which the transversely movable block that supports the cutting blade is shown in a partially sectioned view.

As FIG. 4 in particular clearly shows, the aforementioned circular blade 20 lies in a plane that is perpendicular relative to the material to 16 be cut and said blade 20 rolls on the material during the cutting action, by the simple effect of the rolling contact with the material to 16 be cut. In this way one avoids the need to provide for motorising the rotation of the circular blade 20 about its axis of rotation.

According to the present embodiment, the cutting means 20, in addition to being rotated angularly relative to an axis perpendicular to the material to be cut, are also actuated on the material 16 to be cut according to a first and a second planar direction, in particular according to a first longitudinal direction and in accordance with a second transverse direction, perpendicular to the previous one and indicated respectively as X and Y in FIG. 2.

Each of the cutting units 18*a*, 18*b*, 18*c* comprises support means that are transversely fixed and longitudinally movable and means 30 for directly supporting the cutting means 20 which are movable in a transverse direction relative to said longitudinally movable means.

Figure 5:
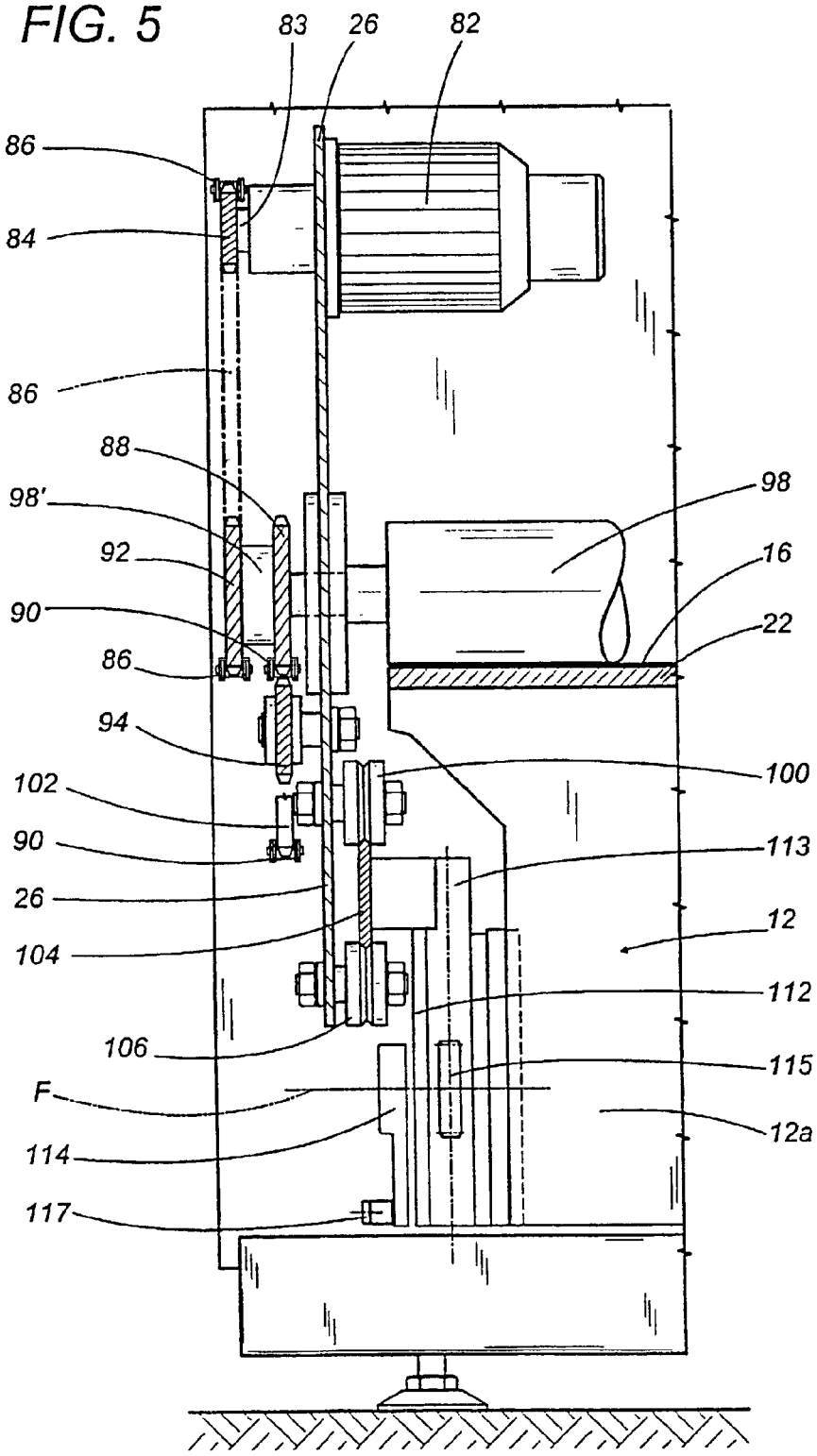
FIG. 5 shows a schematic cross section view taken according to the line V—V of FIG. 4, which relates to a lateral portion of a single cutting unit of the preferred embodiment of the present apparatus.
Figure 6:
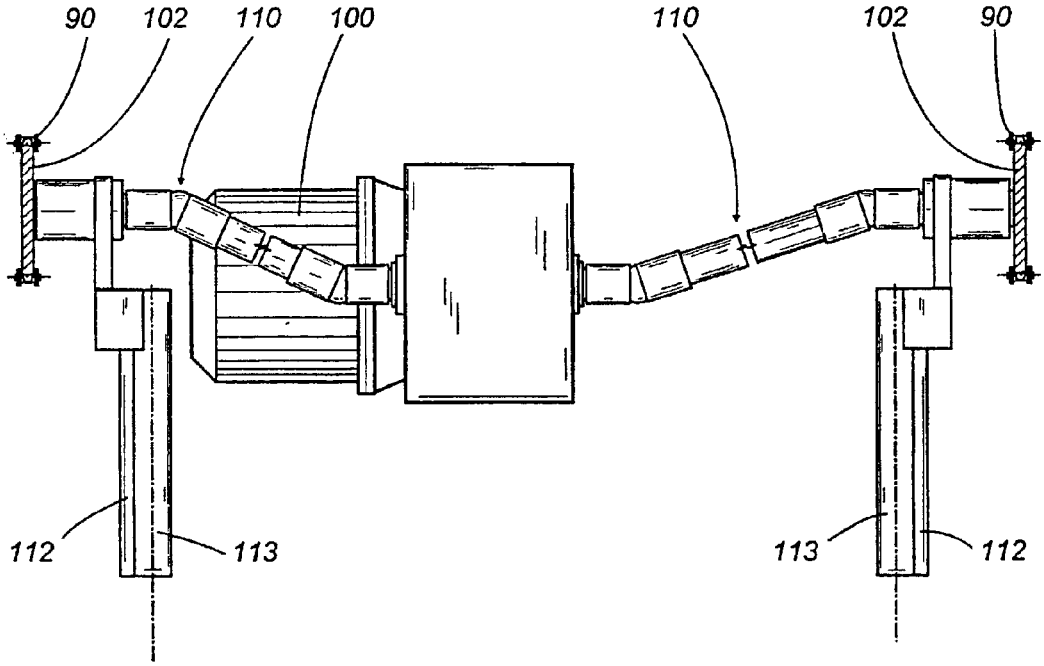
FIG. 6 shows a schematic cross section view, relating to the means for driving the longitudinal chains for advancing the present apparatus.

With reference also to the successive FIGS. 4, 5, 6, it is noted that the aforementioned longitudinally movable support means comprise a beam element 24, prolonging transversely, and opposite first and second plates 26, 28 for supporting said beam element 24 whereto they are connected, in any suitable manner available to the person versed in the art. As shown, said plates 26, 28 are situated in correspondence with the lateral ends of said beam 24.

The means 30 for directly supporting the cutting means 20 comprise, in turn, a main support block 38 transversely movable along said beam 24.

The means 30 for supporting the cutting means further comprise a shaft 40 that bears the cutting blade, whose axis is perpendicular relative to the material to be cut 16 and able to be angularly oriented.

Ball screw means 32, 34 are provided as guiding and sliding means between said transverse beam 24 and said block 38 supporting the cutting means 20.

The means able to rotate said cutting blade 20 by a predetermined angle comprise a control shaft 46 actuated in rotation by corresponding motor means 48, in the form of a brushless electric motor situated on said support block 38, to effect angular movements according to both opposite angular directions.

As shown in particular in FIG. 4, said shaft 46 bears a gear wheel 50 which is coupled, using helical teeth, with a corresponding worm screw 52 integral with said shaft 40 bearing the cutting means 20, to cause its rotation in the two opposite angular direction as a result of a corresponding rotation of said control shaft 46.

The shaft 40 supporting the cutting means 20 has a lower extreme portion 54 for coupling with said cutting means 20, which portion is offset relative to the main axis of said shaft 40, in such away as to position the cutting means 20 aligned to the axis of the support shaft 40.

As shown said cutting means comprise a circular cutter 20 mounted on a drum 56 which is coupled freely revolving, thanks to a respective bearing, not explicitly shown, on a horizontal pivot 58 for connection to said offset extension 54, from which it extends.

Also advantageously provided are means 60 for activating with a predetermined force said cutting means 20 against the material 16 to be cut.

The shaft 40 that bears the cutting means 20 has a portion 40*a* axially movable relative to an axially fixed portion 40*b* that bears said worm screw, whereto said movable portion 40*a* is connected through a grooved coupling that guarantees the driving in rotation of the axially movable portion 40*a* by the portion 40*b*.

Said means 60 act between said axially movable portion 40*a* and said support block 38 and are thrusting means in the form, preferably, of a linear actuator driven by means of a pressurised fluid, in particular by means of compressed air.

The use of an actuator driven by a pressurised fluid allows to provide appropriate means to vary the pressure that said cutting means exert on the material 16. It is sufficient to vary, in an appropriate and desired manner, through appropriate means not shown in the accompanying figures, the working or driving pressure of said actuator 60.

As shall become more readily apparent farther on in the description, by varying within a certain range the driving pressure of the pressurised fluid, it is possible to set a desired cutting pressure, which the aforementioned cutting means 20 exert on the material 16, so that said pressure is suited to the characteristics of the specific material 16 to be cut.

By varying the pressure to a greater or lesser extent it is even possible to move said cutting means 20 between a lowered position for engaging and cutting said material 16 and a raised position for disengagement from said material 16. The latter raised position advantageously allows the free displacement or free rotation of the cutting means 20 relative to said material 16. In practice, this case is particularly useful to execute sudden direction changes, in correspondence with edges or convergence points (see for instance the one indicated with the reference S' in FIG. 2) between two cut lines. This change in direction of cut is obtained by raising and disengaging the cutter from the material, in correspondence with the comer point between two cut lines converging in this point after the cutter has cut the material according to one of said mutually converging cut lines, and rotating it by a predefined angle, suitable for cutting according to the other converging cut line.

The thrust actuator 60 comprises a compression chamber 62 obtained within the support block 38 and a thrust piston 64 fastened to said axially movable portion 40*a* of the shaft 40 that bears the cutting means 20.

The compression chamber 62 is obtained within an upper extreme part 63 of the axial cavity 65 housing the shaft 40 that bears the cutting means 20 and is delimited transversely by an extreme upper closure wall 67 fastened to said support body 38, and on the opposite side, by said thrusting piston 64.

Elastic means, in the form of a spring 66 elastically pre-loaded in compression, act to thrust normally upwards said axially movable portion 40*a* of said shaft 40 supporting the cutting means 20, in opposition to the thrusting action exerted by said pressurised fluid.

For this purpose, the shaft 40 that bears the cutting means 20 has an extreme prolongation 68 that prolongs through a hole 69 in said rear closure wall 67. Said elastic means act between the upper face of said transverse closure wall 67 and an enlargement 70 provided at the extremity of said prolongation 68 of the shaft 40 bearing the cutting means 20.

The spring 66 thrusts the cutting means upwards in the condition of disengagement from the material; by adjusting pressure inside the pneumatic cylinder to a predefined level, it is possible to obtain the exertion of a desired pressure by the cutting blade against the material to be cut. By decreasing said pressure within the pneumatic cylinder to a sufficient extent, it is possible to obtain the total lifting or disengagement of the cutting blade from the material.

The present apparatus further comprises appropriate means 22 for supporting said material 16, which are in the form of a plane 22 for supporting the material and able to define suitable contrast means 22 for said cutting blade 20.

Said support and contrast plane is obtained from a planar plate 22, whereon the material 16 bears, which extends horizontally in correspondence with the cutting area T alone.

As successive FIG. 5 also shows, the aforesaid bearing plate 22 is integral with a fixed base 12*a* of said support frame.

As shown in particular in FIG. 1A, positioned downstream, according to the direction of advance of the material, and at the same level as the plate 22, there extends horizontally a removable plane 23 for supporting an already cut piece of said material, whose specific use shall become more readily apparent farther on.

Preferably, said bearing plate 22 is made of hardened steel, or of a material that is hard and also an electrical conductor, however it could also be made of glass having appropriate hardness, of granite, marble, basalt, sandstone, carborundum or other suitable material. A preferred hardness of such materials defining the bearing place could be equal to 60 HRC (the hardness of hardened steel).

As shown, the means for transversely moving the organ 38 supporting the cutting means 20 comprise motor means 72, in the form of a brushless electric motor, situated on said longitudinally movable support means, in correspondence with an extreme plate 26.

Said motor means 72 drive, through a driving pulley 74 mounted on a control shaft 76 of the motor 72, a continuous endless element, in the form of a positive drive belt 78. The continuous element 78 extends transversely driven on the aforesaid driving pulley 74 as well as on a pulley 80 positioned on the transverse side opposite to the one in which the driving pulley 74 and which is mounted freely revolving on said transverse beam 25 (see FIG. 2 and 3).

Appropriate means are provided for fastening said transversely movable means 30 to said continuous element 78 to allow the translation thereof in the transverse direction. These fastening means are not expressly shown in the accompanying figures and are in any case feasible for the person versed in the art. In practice, said block 38 is integral with a point of the pulley 78 and the motor 74 is appropriately controlled to cause said belt 78 in two opposite direction, forwards and backwards, to move transversely in a desired manner said block 38 and the blade 20 borne thereon.

The means that instead serve to move longitudinally said cutting means 20 comprise motor means, in the form of an electric motor 82, of the brushless type, which is situated on said transversely fixed support means, being, in the specific case, supported by the plate 28, which is opposite to the one 26 in correspondence with which are supported the motor means 72 of the transverse actuation of the cutting means.

The motor means 82 activate, in driving action, coupling means, in particular in the form of a first pair of gear wheels 88, 88, transversely opposite, which mesh with a corresponding continuous element 90, 90 extending longitudinally.

Said first and second continuous element 90, 90, are in particular in the form of respective continuous endless chains, wound in a loop on respective gear wheels better described farther on.

The aforementioned longitudinal chains 90, 90 extend longitudinally at the opposite transverse sides of the cutting and removal area and present each at least an active branch which extends horizontally.

The gear wheels 88, 88 are driven in rotation and enmesh with the upper active branch of the aforementioned chains 90, 90 which in the occasion are kept fixed, to obtain the longitudinal translation of the cutting unit, during the normal material cutting operations.

A second pair 87, 87 of coupling means is provided, in the form of respective gear wheel meshing with the continuous means 90, 90. Said second pair 87, 87 of meshing means is not provided with specific driving means, the wheels 87, 87 roll on the chains 90, 90 as a result of the driving action provided by the first pair of wheels 88, 88.

As shown in particular in FIG. 4, for the meshing of said gear wheels 88, a further gear wheel 84 is used which is mounted on the shaft of said motor 82 and through an additional short continuous element, in the form of a transmission chain 86, a gear wheel 92 is activated which is coaxial and fastened to one of said gear wheels 88 for meshing with the longitudinal chain 90.

As shown especially in the aforesaid FIG. 4, contrast means are provided, in the form of a respective revolving roller 93, 94 acting on the opposite side of the chain 90, to favour the enmeshing of said gear wheel 87, 88. The contrast rollers 93, 94 are mounted on said movable support means, in particular in correspondence with a lower extension of the corresponding lateral plate of the cutting unit 18*a*, 18*b*, 18*c*. FIG. 4 shows only the side relating to the lateral plate 28; the side of the plate 26 has a similar configuration.

Advantageously, means 96, 98 are provided, able to hold still the material 16 to be cut in correspondence to the cutting means 20.

The means for holding the material in correspondence with the cutting means 20 preferably comprise a first 98 and a second 96 rollers for contacting and pressing against said material 16, which extend transversely and are longitudinally distanced from each other in such a way as to allow the disposition of said cutting means 20 between them.

The present retaining rollers 96, 98 also define means for sustaining said support means 24, 26, 28, 30 of the fixed cutting means 20.

The first roller 98 is connected integral with the first pair of meshing wheels 88, 88 and it is driven by them to roll on the material, when said cutting means 20 must move longitudinally on the material 16 to execute longitudinal or generally oblique cuts. The second roller 96 in turn is connected integral between the second pair of gear wheels 87, 87 and is, in turn, driven to roll on the material by said wheels 87.

Said retaining rollers 96, 98 are connected in a freely revolving manner to said first and second lateral plates 26, 28, of the transversely fixed support means, thanks to respective lateral shafts connecting to the corresponding gear wheels 88, 88 and 87, 87, which connecting shafts pass through corresponding holes in the aforementioned plates, which they support and whereto they are coupled in a freely revolving manner preferably through suitable bearings not expressly shown in the accompanying figures. FIG. 3 shows only the connection shafts 96', 96' of the driven roller 96, whilst FIG. 5 shows one of said connection shafts 98' for the driving roller 98.

Said retaining rollers 96, 98 also have a peripheral profile for contacting the material to be cut, which is conveniently rubber coated or has a corresponding surface for preventing any sliding relative to the material to be cut.

In the present apparatus are also provided advantageous means for advancing the material. Said advancing means are, in particular, such as to advance the material already cut from a cutting area T to an area S downstream of the cutting area T, which area S defines an area for removing the material already cut, whose disposition allows to make independent the cutting operations from the operations for removing cut material from the apparatus. The advancing means are such as not to advance the material during the cutting of a piece of predefined length into corresponding shaped portions 16*a* in correspondence with the cutting area T.

Advantageously, in the present apparatus, to obtain said advancement of the material said means 96, 98 for retaining the material and said means 90, 90 for advancing said retaining means are used. For this purpose the aforementioned roller retaining means 96, 98 are engaged on the material and held still in the rotation in order to bear on the material itself and thrust it against the opposite bearing means 22, 23.

Figure 1B:
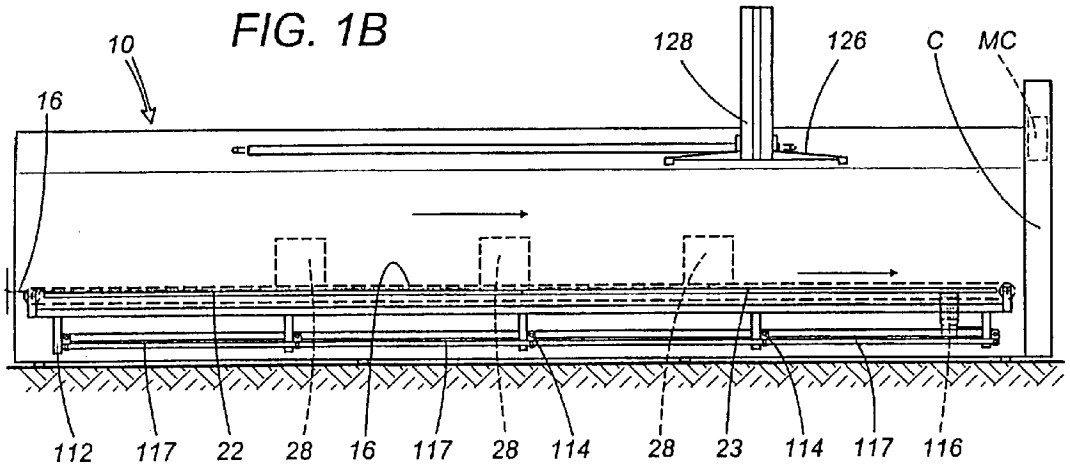
FIGS. 1B, 1C, 1D, 1E, 1F, 1G, similar to FIG. 1A, show respectively said preferred embodiment of the present apparatus, with reference to different operative conditions of the apparatus.

By driving longitudinally in advance or in forward translation the continuous longitudinal means 90, 90 or by making the coupling chains rotate appropriately, said units 18*a*, 18*b*, 18*c* are driven forwards, as shown in FIG. 1B, where the arrow M indicates the advance of the two-dimensional material 16, the arrow U highlights the advance of the cutting units 18*a*, 18*b*, 18*c* and the arrow C indicates the advance of the lateral chains 90, 90. In this phase the two forward cutting heads 18*b*, 18*c* drive the material that has been cut, whilst the rear head 18*a* drives the ribbon unwinding it from the spool 14 (shown in FIG. 1A).

Thanks to the retaining contact by said rollers 96, 98 on the material 16 said advance of the chains drives forward the material which is made to slide longitudinally on the plate 22 and on the successive bearing plane 23.

This material driving operation causes the unwinding of the ribbon 16 and the positioning of fresh material, still to be cut in correspondence with the cutting area.

To obtain such joint advance of the cutting units, the respective rolling motors 82 are kept blocked and the gear wheels 88, 88 are held still and engaged to the corresponding chains 90, 90.

As shown especially in FIG. 6, motor means 100 are provided for actuating said first and second transversely opposite continuous translation elements 90, 90. Said motor means 100 are in the form of a single electric motor connected by means of corresponding transmission organs 110, 110 to said continuous elements 90, 90.

Means, in the form of longitudinally aligned gear wheels, whereof only the rear driving wheels 102 are shown in FIGS. 4 and 6, are provided for driving said continuous elements 90, 90.

Figure 1C:
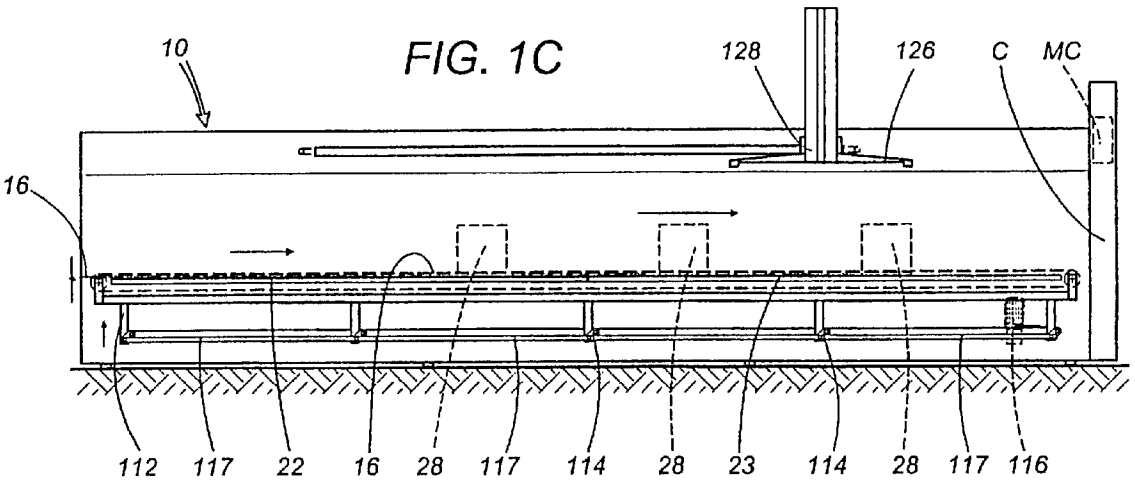

Once said ribbon of material 16 has been sufficiently unwound to guarantee the cutting of the successive piece, as shown in FIG. 1C, the cutting units 18*a*, 18*b*, 18*c* are raised together and with the driving means 90, 90, as shown in the arrow indicated as V in said FIG. 1C, in such a way as to be disengaged from the material 16 and advanced as indicated by the arrows U and C. In this condition the material remains still.

Once a longitudinal segment of predefined length has been travelled, the units 18*a*, 18*b*, 18*c* are again lowered together with the driving means 90, 90 coming once again in contact with the material (such lowering is not expressly shown in the accompanying figures). The lowering of the cutting units 18*a*, 18*b*, 18*c* takes place with the rear unit 18*a* no longer in contact with the front end of the ribbon and instead in contact with the rear part of the cut piece.

At this point, with the cutting units in contact with only the cut piece, the driving means 90, 90 are actuated to advance, allowing the sliding forward of the cut piece and the longitudinal separation thereof from the ribbon of material to be cut. In this final phase of advance of the unit and of the cut pieces, the units reach the advanced position of FIG. 1D in which the piece is set in a suitable and desired position on the removal plane 23.

According to the present embodiment of apparatus, means are also provided for returning said cutting units 18*a*, 18*b*, 18*c* back to the cutting position.

Said return means comprise means for lifting, translating backwards, and lowering said cutting units relative to the material 16 in the stopped condition.

Otherwise stated, means are provided for disengaging, i.e. lifting, the cutting units relative to the material 16 and to allow their free relative movement in the longitudinal direction relative to said material and, in particular, to allow its return backwards, as well as to engage, or lower, said cutting means 20 on said material 16.

Said engagement and disengagement means comprise beam means, in the form of a first and of a second lateral beams which extend longitudinally and whereof only one, indicated with the numerical reference 104, is partially shown in FIG. 4.

The cutting units are connected to said beams 104 in a sliding manner in the longitudinal direction and in a fixed manner in the perpendicular direction. The beams 104 define means for guiding the longitudinal displacement of said cutting units.

As shown in particular in FIG. 4, the single cutting unit comprises in this regard a plurality of rollers 106 for sliding on the beam means 104 extending longitudinally. Said rollers 106 are connected in a freely revolving manner to a respective lateral plate, in particular FIG. 4 shows the plate 28, of the cutting unit 18*a*, 18*b*, 18*c* and slide on opposed longitudinal tracks defined by said beam means. Through this connection it is possible to provide for the perpendicular raising and lowering of the cutting units, in particular for the execution of the during the collective backward return manoeuvres successive to the forward driving of the material.

Suitable means are provided for moving perpendicularly said beam means 104 and causing the raising and, respectively, the lowering of the cutting units relative to the manual 16.

According to the present embodiment, by raising the longitudinal beams 104 one also obtains the lifting both of the cutting units 18*a*, 18*b*, 18*c*, and of the corresponding continuous advance elements 90, 90.

The motor means 100 are connected, as clearly shown in FIG. 6, to said continuous longitudinal translation elements 90, 90 through corresponding cardanic transmission means 110, 110 which allow to keep the motor 100 fixed to the frame and to raise said continuous elements perpendicularly upwards.

Figure 1D:
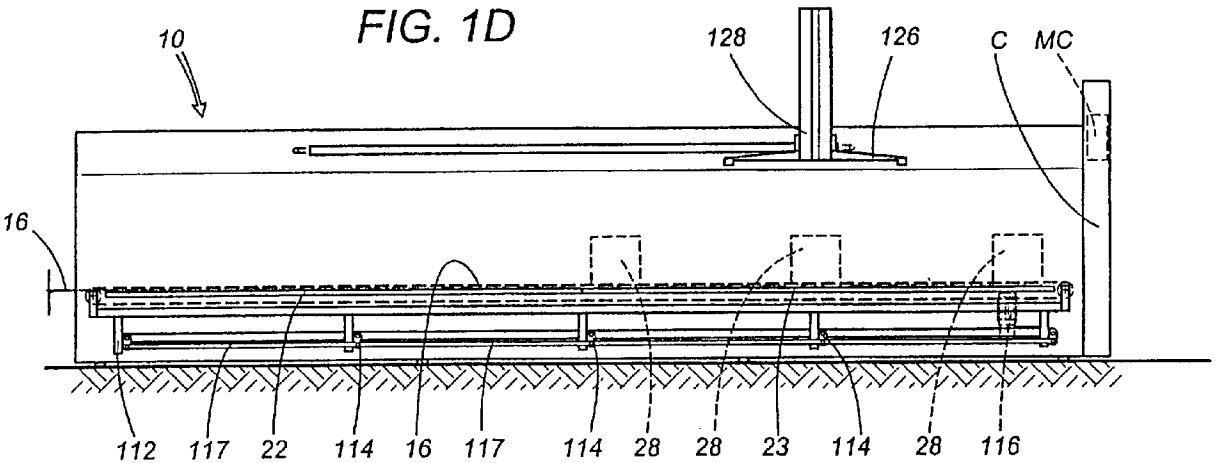
Figure 1E:
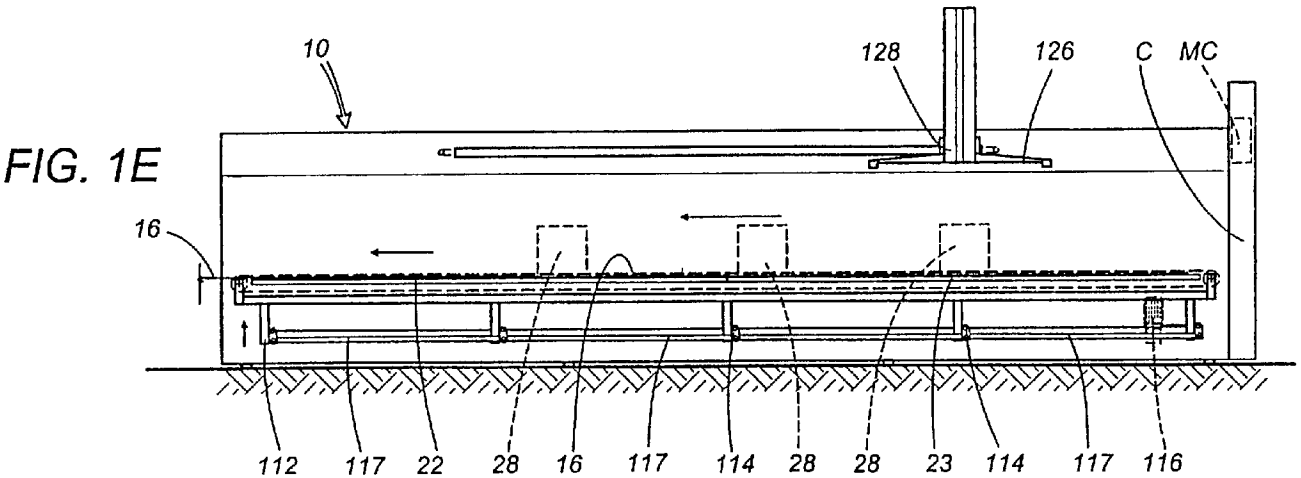

By operating said motor 100, and hence said chains 90, 90, in a rotation contrary to the direction of advance of the units 18*a*, 18*b*, 18*c*, one obtains (as shown in FIG. 1E), with said cutting units and the translation chains 90, 90, in a raised condition, the rapid return of said cutting units into the starting position of FIG. 1A. In FIG. 1E, the arrows V, C and U show, respectively, the vertical movement of the assembly and the backward movement of the driving means and of the cutting units.

As shown in FIG. 1A, the aforementioned means for raising and lowering the cutting unit comprise, in turn, strut means 112, in the form of a plurality of longitudinally distributed struts 112, which are connected to the corresponding longitudinal beam 104, and means for activating said strut means in a direction perpendicular to the plane 22, 23 for supporting the material.

As can be better observed also with reference to the aforementioned FIGS. 3 and 5, said perpendicular activation means comprise, as shown particularly in said FIG. 5, rack means 113 on said strut means 112 and corresponding gear means 115, revolving in opposite angular directions and meshing with corresponding rack means 113 to effect the aforementioned raising and lowering action.

The gear means 115 are integral with arm means 114, which are pivotally engaged to said frame through the axis or rod, schematically indicated as F in FIG. 5,—which also bears the gear 115. Said arm means 114 are able to be rotated by a predefined angle. Said arms 114 of each longitudinal side of the apparatus are activated simultaneously by shared bar means 117, extending longitudinally to the machine and driven by corresponding actuator means, constituted by a single motor 116, better shown in FIG. 3. The electric motor 116 is fastened to said frame and by means of appropriate transmission organs 116', known to the person versed in the art, causes the longitudinal translation of a first and of a second transverse rods 119, 119, which drive respectively and simultaneously, through appropriate transmission means not expressly shown in the accompanying figures, in longitudinal translation the bar elements 117 of both longitudinal sides of the apparatus. The simultaneous rotation is thereby obtained of all said arms 114 of the apparatus and the consequent perpendicular actuation, through gears 115 and racks, of the corresponding struts 112.

According to the present apparatus, on said support frame are also provided appropriate means for storing the material 16.

As shown in FIG. 1A, said storage means are, in particular, situated, saving space, in the cutting area T.

The storage means comprise a support plane 125 whereon is created a stack 123 of the cut pieces.

Appropriate means for withdrawing and transferring the material 16 are provided to transfer the material form the area S for the temporary storage ST of single cut pieces and said storage area.

Said transfer means comprise means for gripping the cut piece in correspondence with the transfer area S. The gripping means advantageously comprise said removable bearing plane 23 whereon said cut piece is borne by said cutting means.

Appropriate means for gripping said bearing plane 23 and means for actuating said gripping means of said bearing plane 23 are employed. The means for gripping the bearing plane 23 comprise a first and a second arms, only one indicated by numerical reference 126 being shown in FIG. 1A, positioned transversely opposite and provided with appropriate means (not expressly shown and in any case known to the person versed in the art) for engagement with said bearing plane 23 in correspondence with the lateral longitudinal edges thereof.

The bearing and removal plane 23 is supported by the base 12*a*. An appropriate bearing and housing seat is provided on the base 12*a* to allow for an easy removal and repositioning of said plane 23.

The gripping arms 126 are borne by a support frame 128 that is vertically movable, thanks to suitable driving means constituted by the motor 130, relative to a perpendicularly fixed frame 132.

Figure 1F:
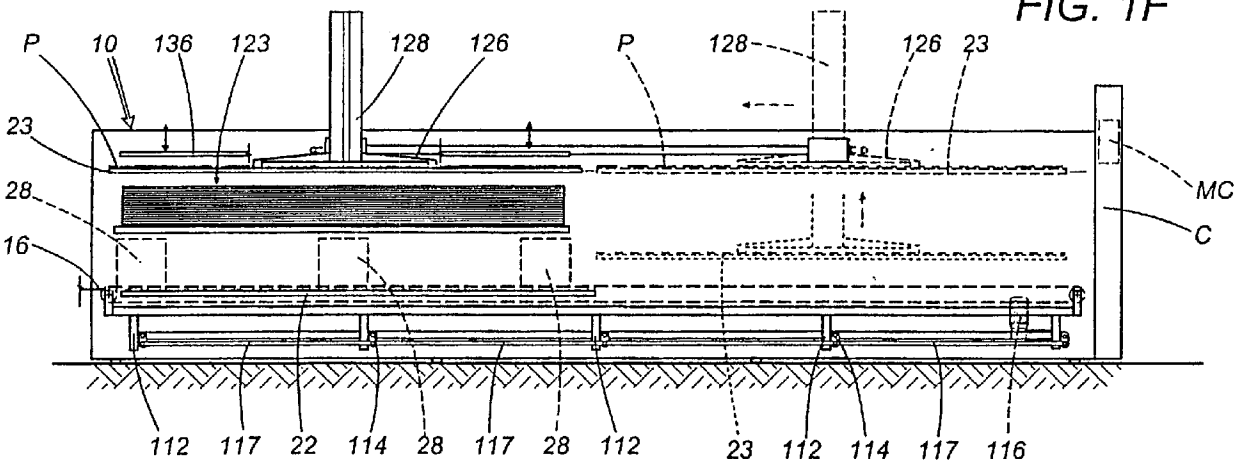

Suitable means are provided for the longitudinal displacement of said perpendicularly fixed frame 132, along respective longitudinal guide means 132', to and from said storage area, as shown in FIG. 1F.

In correspondence with the area for storing the pieces in stacked condition, means for transferring the cut pieces from said gripping means 23 to the stack or to the support plane of said storage means 125 are provided.

Figure 1G:
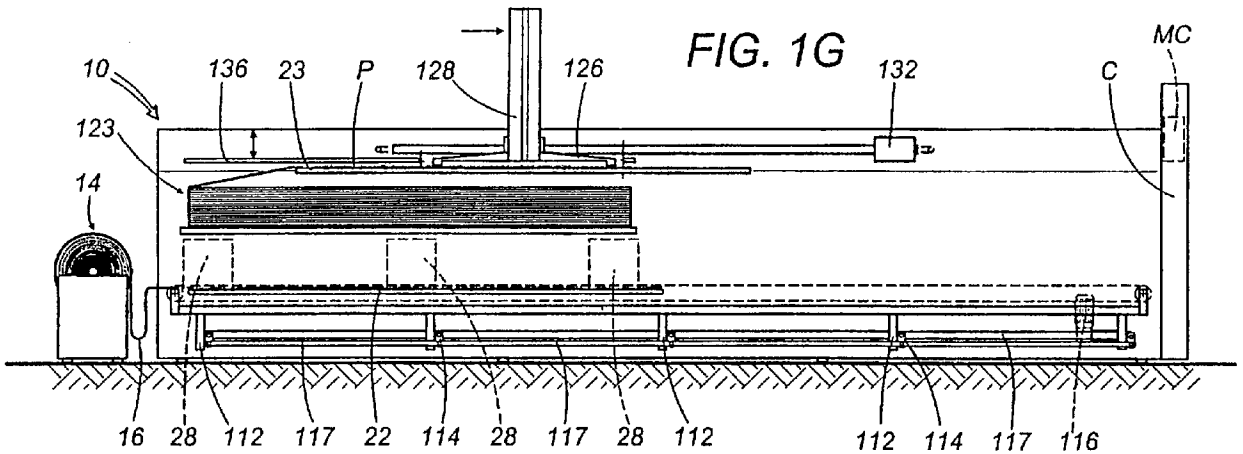

The aforesaid transfer means comprise a checking surface 136 schematically shown in the figures, which, as specifically shown in FIGS. 1F and 1G, is perpendicularly movable to move from a raised position, in which (see FIG. 1F) it allows the insertion, by the means 130, of said plane 23 below the checking surface 136 and a lowered position (see FIG. 1G), in which said surface 136 engages the cut piece set down on the plane 23 and allows, thanks to the return of the same plane 23 towards a position above the aforesaid area P, to hold still the piece that slides on the plane 23 itself whilst the latter moves away and is thereby progressively laid onto an opposite surface of an upper piece of the stack 123 or, lacking stored pieces, on the bearing plane of the storage means 125.

According to another advantageous aspect, means 120 are used for weakening the material in correspondence with the contact between the cutting means and the material to be cut. The weakening means according to a preferred embodiment are in the form of means for softening the material.

Said softening means are advantageously in the form of means for heating the material 16.

Said heating means can heat said material directly, or can be able to heat said cutting means 20 and the support plate 22 obtaining an indirect heating of the material.

Such means for weakening or pre-treating the material in correspondence with the cutting line can however also be in the form of means able to render the material 16 more fragile, means able to set the material 16 in mechanical vibration, or means able to set molecules constituting said material 16 in molecular vibration.

The means 120 able to weaken the material are sent on said material by said cutting means 20, in particular they are connected, through appropriate connections 122, 124, between said cutting means and said support plate 22.

As shown, the weakening means are, in particular, connected to an end of the shaft that bears the cutting means 20.

Preferably, said weakening means are in the form of a direct current that is made to pass through the material, thanks to the fact that said shaft supporting the blade is made, like the plate supporting the material, of electrically conductive material.

However, ultrasounds, electromagnetic waves, or high and medium frequency electrical currents could also be used.

As stated above, means MC for controlling the operation of the present apparatus are used, which means, as shown schematically, are housed within a head compartment C'.

As described above, in a particularly preferred manner, the control means MC comprise computer means operating according to a pre-set work program, such as to render the present apparatus completely automatic.

Briefly, the aforementioned control means MC activate the motors for the longitudinal and transverse actuation and for the rotation of said cutting means 20 in order to obtain therefrom the cut of the related shaped portion 16*a* in a corresponding piece. In these phases, the longitudinal chains 90, 90 are held still and, thanks to the rotation of the gear wheels 88, 88, and indirectly of the gear wheels 87, 87, the longitudinal advance of the cutting units is obtained as well as the rolling of the rollers 96, 98 on the material which is held still and thus allows the execution of a safe and accurate cut by the cutting means. In these phase, the transverse translation of the block 38 is also commanded as well as an appropriate rotation of the blade-bearing shaft.

After the completion of the cutting phase, the control unit commands the blocking of the rotation of the gear wheels on the corresponding longitudinal chains 90, 90 and makes the latter move forward in such a way as to cause, as shown in FIG. 1B, the collective advance of the cutting units 18*a*, 18*b*, 18*c* which drive, thanks to the engagement of the rollers 96, 98, said material 16 forward. In this phase the material slides on the underlying planes 22 and 23.

As shown in FIG. 1C, to separate the cut piece from the ribbon, the cutting units are raised relative thereto and they are made to advance by a predefined segment and then lowered again only on the cut piece to proceed with a new advance, this time of the cut piece of material alone.

To obtain a rapid return of the cutting units after they have reached the position of maximum advance in FIG. 1D, said control unit commands the joint raising, relative to the plane of bearing of the material, of the cutting units which are disengaged from the material, and of the longitudinal chains 90, 90, as shown in FIG. 1E. At this point the chains 90, 90 are driven backwards, i.e. made to rotate in a direction opposite the direction of advance, and bringing the cutting units 18*a*, 18*b*, 18*c* to the position overlying the initial cutting position, in correspondence with which the lowering of the same units is commanded relative to the plane to engage the fresh material to be cut, thereby returning to the cycle start condition of FIG. 1A.

In the new cutting phase that is executed on a new piece in correspondence with the area T, the latter piece is separated at the front from the previous cut phase, which is now in correspondence with the front area S.

It is therefore possible to cause (see FIG. 1F) the plane 23 for supporting the material in the front part of the apparatus to be raised and carry the cut piece in correspondence with the storage area located, limiting size, above the cutting area T and in correspondence with which, by moving said plane 23 backwards and the check surface 136 in lowered condition, the extraction of the cut piece from the plane 23 is obtained as well as its transfer to the stack, as shown in FIG. 1G.

When the stack 123 of cut pieces reaches the appropriate size, it can be removed, with the utmost ease, using suitable means or manually by the operators.

In the present apparatus, the actuation of the cutting means 20 on the material to be cut comprises phases entailing a displacement on the material and simultaneous cutting thereof and phases entailing a displacement without the cutting of the material.

In practice, an apparatus has been provided that is substantially automatic and requires the employment of a minimum number of personnel to carry out the mere monitoring of the productive method implemented by the present apparatus. The size of the present apparatus in relation with prior art apparatuses is definitely small.

The cutting of a piece of material effected with the present apparatus and, in particular, making use of revolving cutting means can be effected in a particularly rapid manner.

Although a preferred embodiment has been illustrated in which a single layer of material is cut, one could also imagine executing the cut on multiple superposed pieces or layers of material, for instance 3 or 4 pieces or layers.

The present apparatus also allows to respect lines and colours, as well as any defective or faulty areas in the material.

The present apparatus avoids the 40–50 layer stacking that must be effected for prior art apparatuses.

Moreover, the present apparatus allows to avoid using prior art means for aspirating and retaining the plurality of layers, with the consequent reduction of the noise level and heating inside the work spaces.

The present apparatus is, in general, suitable for cutting any kind of two-dimensional material, however it was particularly conceived for cutting fabrics or the like, in particular fabrics destined to the clothing industry, to the furnishing industry, and the like: in practice, in those industries in which said material must be appropriately separated and shaped, generally in view of a subsequent composition into finished products, starting from a larger blank.

The successive figures show a second preferred embodiment of the present apparatus.

Said second embodiment has a certain number of components that are wholly similar to those of the previous embodiment. To avoid excessively burdening the present description, these components or features in common with the first illustrated embodiment are therefore not described again in detail and retain the same references used for the first preferred embodiment.

In particular, in this second preferred embodiment, the cutting units 18*a*, 18*b*, 18*c*, are in themselves wholly similar to the unit for cutting the first preferred embodiment. However, these cutting units are actuated, to allow the longitudinal transfer of the pieces or swathes of material, in a different manner from the one related to said first preferred embodiment.

This second preferred embodiment of apparatus has a first section A, situated upstream, in which the cut is effected, which is substantially similar to the similar section of the first preferred embodiment, and a second section B, positioned downstream of the first section, in which the pieces cut by the present apparatus are accumulated and offloaded.

In a manner similar to the first embodiment, in this second embodiment the ribbon like material 16, unwound from a spool 14, is positioned on a support plate 22, wholly similar to that of the first preferred embodiment, where the aforementioned cutting units 18*a*, 18*b*, 18*c* operate.

In this second preferred embodiment, the presence of movable rotating lateral chains to allow the movement for driving the material by said cutting units 18*a*, 18*b*, 18*c* is not provided. Differently, in this second embodiment, as FIGS. 8A and 11 clearly shows, meshing means are used that are fixed, at least in the longitudinal direction, and that comprise, for each side of the machine, a respective rack 90', 90', which extends longitudinally and is engaged by respective gears 87, 88 of the cutting units, which, appropriately actuated in rotation, allow to move longitudinally the aforesaid cutting units to execute cut lines that extend with at least a longitudinal component.

Said longitudinal racks 90', 90' could in any case also be obtained by means of a respective chain portion extending longitudinally and such as to allow for an easy meshing action and a considerable structural simplification for this detail.

In this second preferred embodiment, the cutting units 18*a*, 18*b*, 18*c*, as takes place for the first embodiment, are longitudinally movable in order to execute oblique or curved cuts, or for the execution of transfer displacements between a just executed cut line and a cut line to be executed subsequently.

Moreover, the aforementioned cutting units 18*a*, 18*b*, 18*c* are movable collectively in the vertical direction, between a lowered position, for engaging and cutting the material, and a raised position (shown in dashed lines in FIG. 8A) which allows, as shall become more readily apparent farther on, the driving of the just-cut piece towards a storage and removal area, located downstream, by appropriate means for gripping the material which insert themselves underneath the cutting units 18*a*, 18*b*, 18*c* in the raised condition.

Figure 8A:
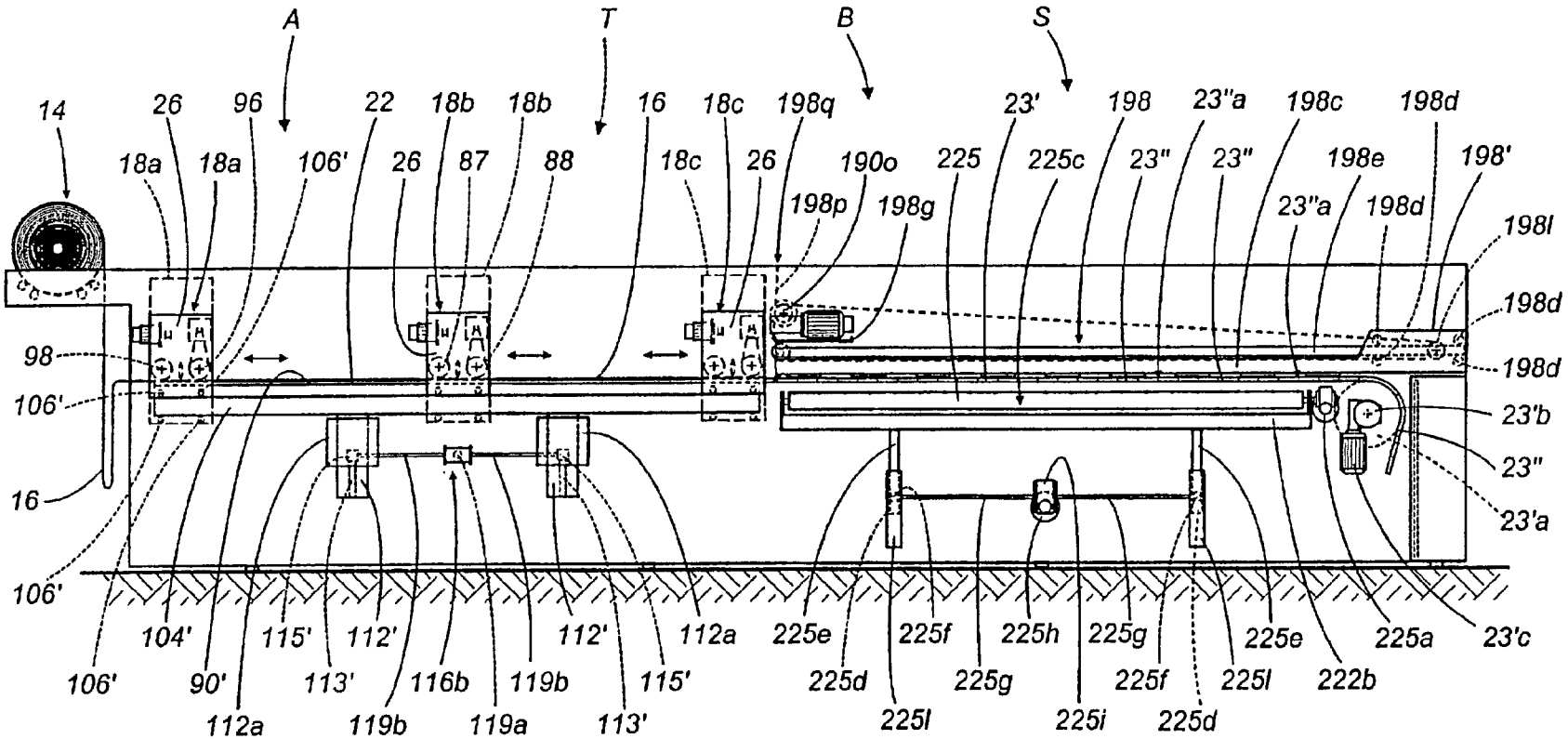
FIGS. 8A through 8F show lateral schematic views of a second preferred embodiment of the present apparatus, with reference to different operative conditions of the apparatus.
Figure 11:
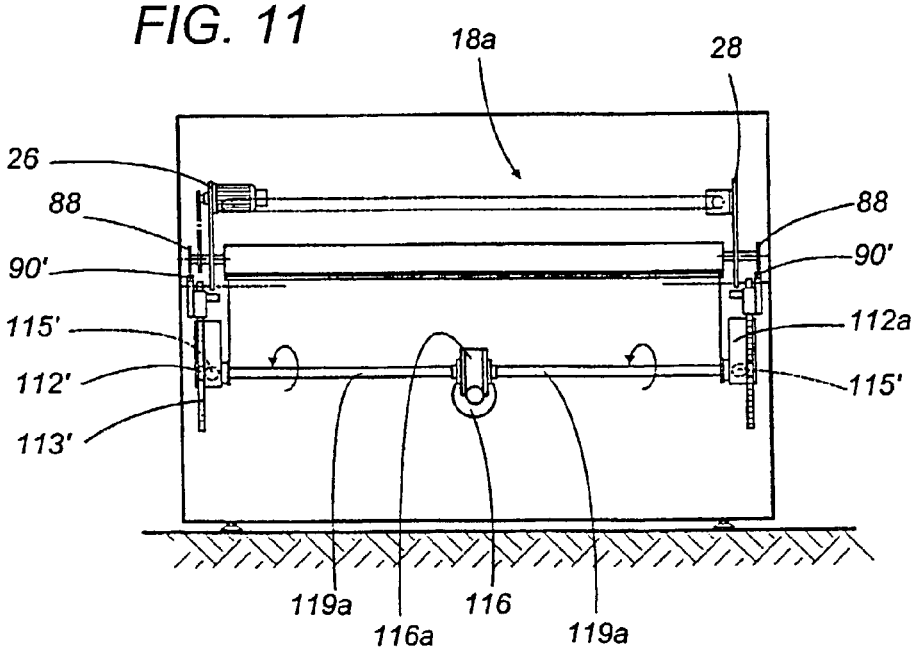
FIG. 11 shows a schematic transverse view of the second preferred embodiment of the present invention.

As can be observed with reference to the aforementioned FIGS. 8A and 11, to effect the collective raising and lowering of the aforementioned cutting units 18*a*, 18*b*, 18*c*, similarly to the first preferred embodiment, motor means 116 are used (shown in FIG. 11) which, through appropriate transmission means, command the rotation of corresponding gears 115' such as to move vertically corresponding racks 113' positioned on respective strut means 112' connected to corresponding longitudinal beam elements, only one—indicated with the numeric reference 104'— being shown in FIG. 8A. Said struts 112' vertically guided and movable relative to fixed columns 112*a* of the frame.

These longitudinal beam elements support and guide longitudinally said cutting units 18*a*, 18*b*, 18*c*, which are connected in a sliding manner to said longitudinal beams through rollers at the lower ends of the respective lateral plates 26 and 28 of the cutting units. FIG. 8A shows only the rollers 106' related to the plate 26, able to slide on the longitudinal beam 104'.

The transmission means between said motor 116 and the gears 115' comprise a pair of transverse shafts 119*a*, 119*a* which are actuated in simultaneous rotation by said motor 116 through a corresponding gearbox 116*a*. These shafts 119*a*, in turn, set in rotation, through a second gearbox 116*b*, respective longitudinal rods 119*b* connected to the gears 115'.

In this second preferred embodiment, the movable support plane 23', in correspondence with the downstream storage area S, is in the form of a two-dimensional body, flexible or able to fold according to the longitudinal direction and supported laterally by appropriate guides, not shown in the accompanying figures.

As FIG. 8A shows, the movable support plane 23' is driven to move, along the path defined by the aforesaid lateral guides, through at least a wheel 23'*a* for engaging and driving said plane 23', which is coaxially integral with a corresponding transmission wheel 23'*b*, in turn connected, in motion transmission, to the gear mounted on the shaft of a corresponding actuating motor 23'*c*.

Figure 8B:
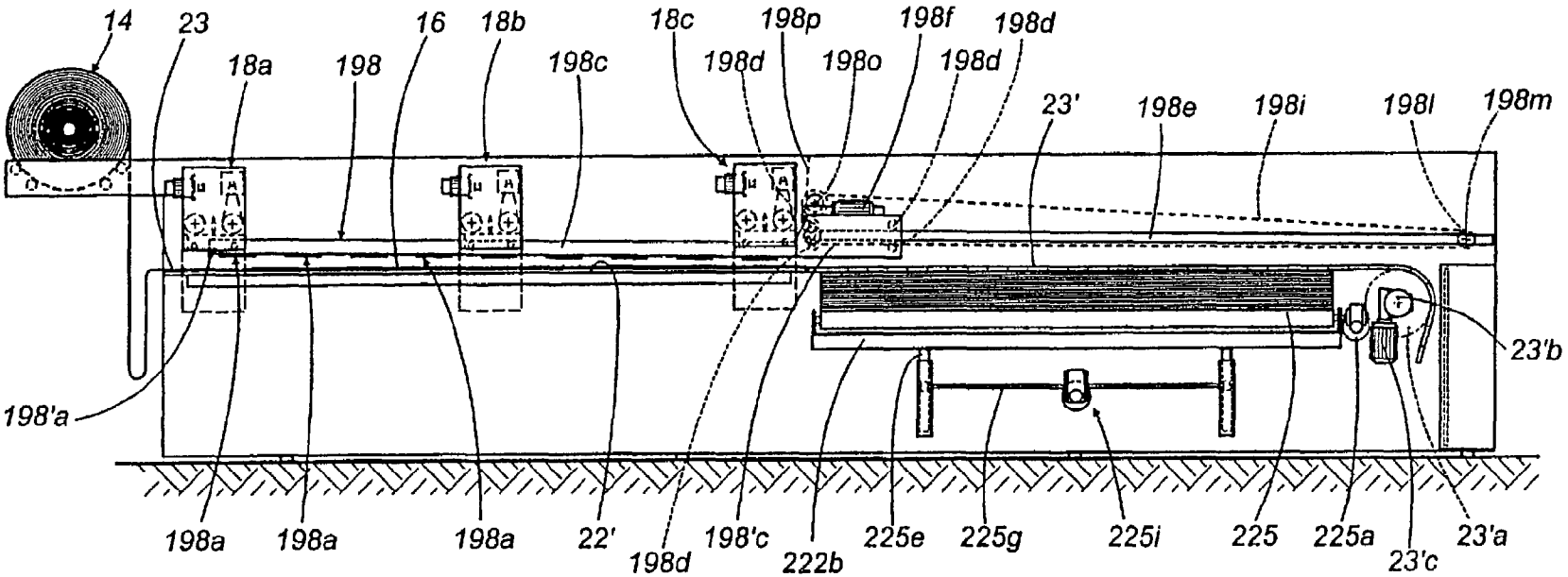
Figure 8C:
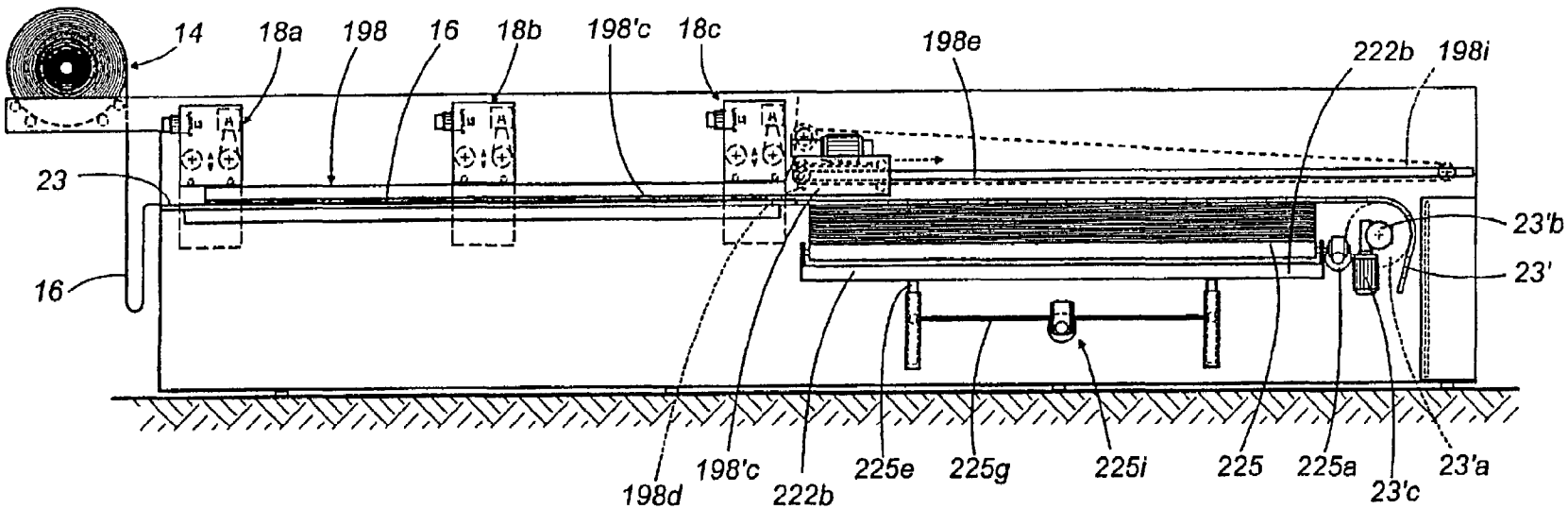
Figure 8D:
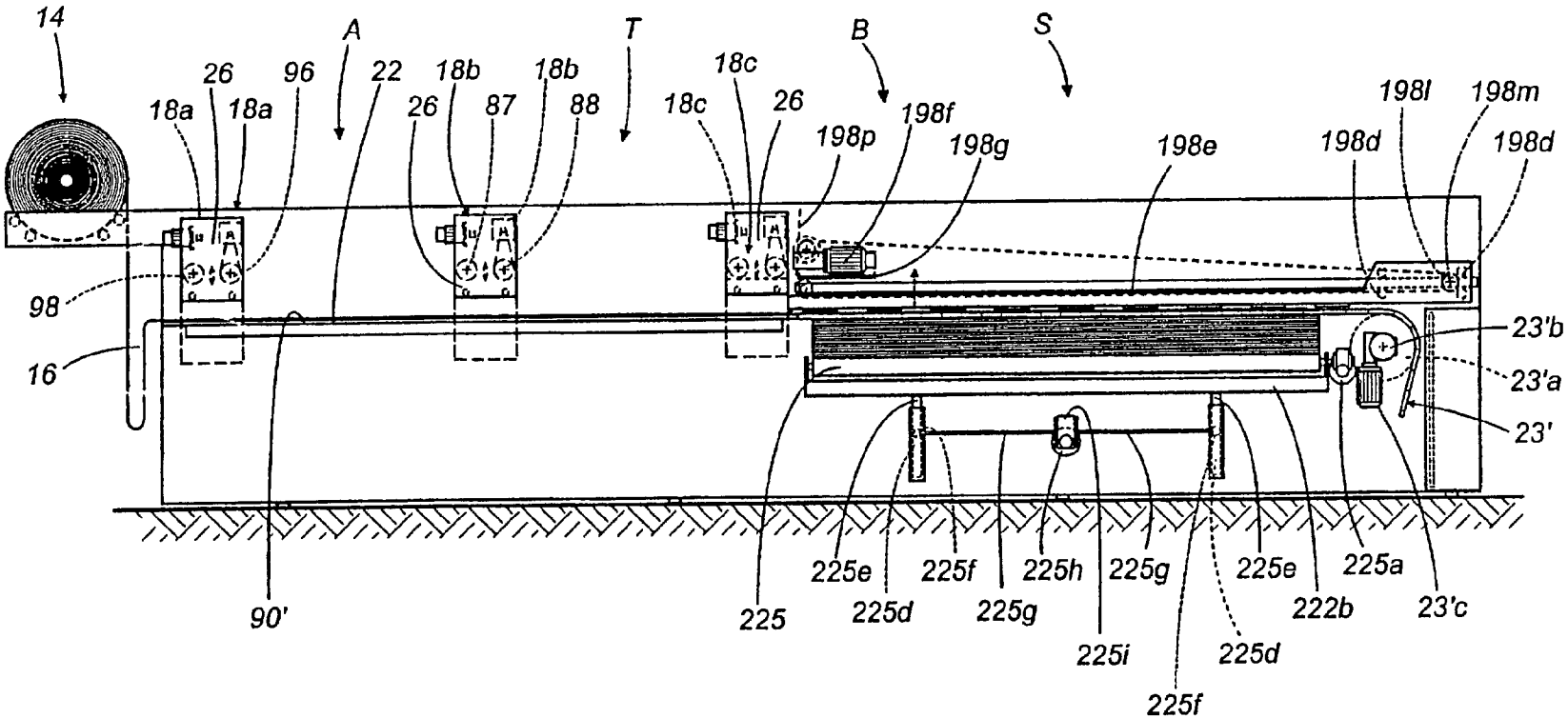
Figure 8E:
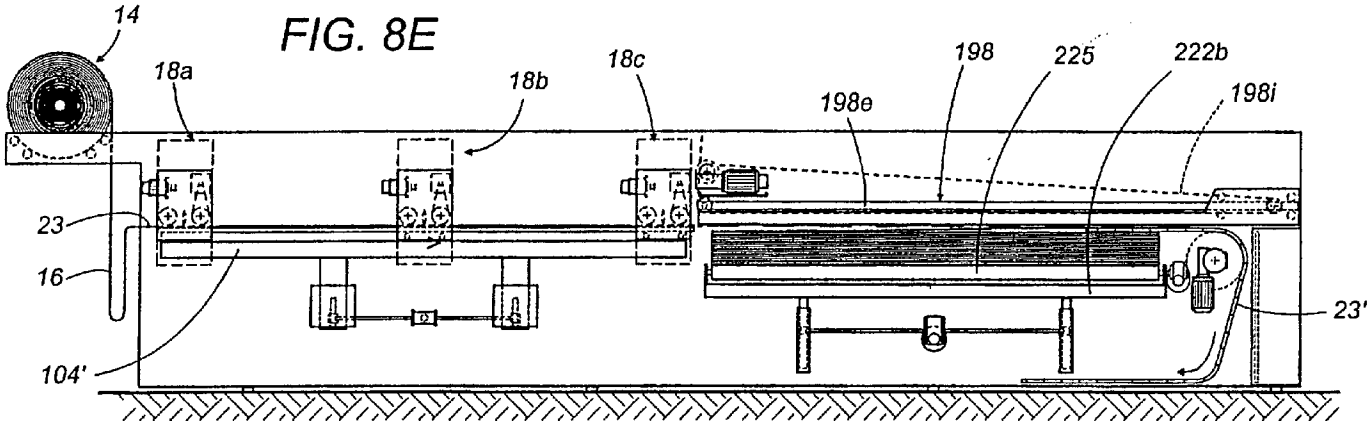
Figure 8F:
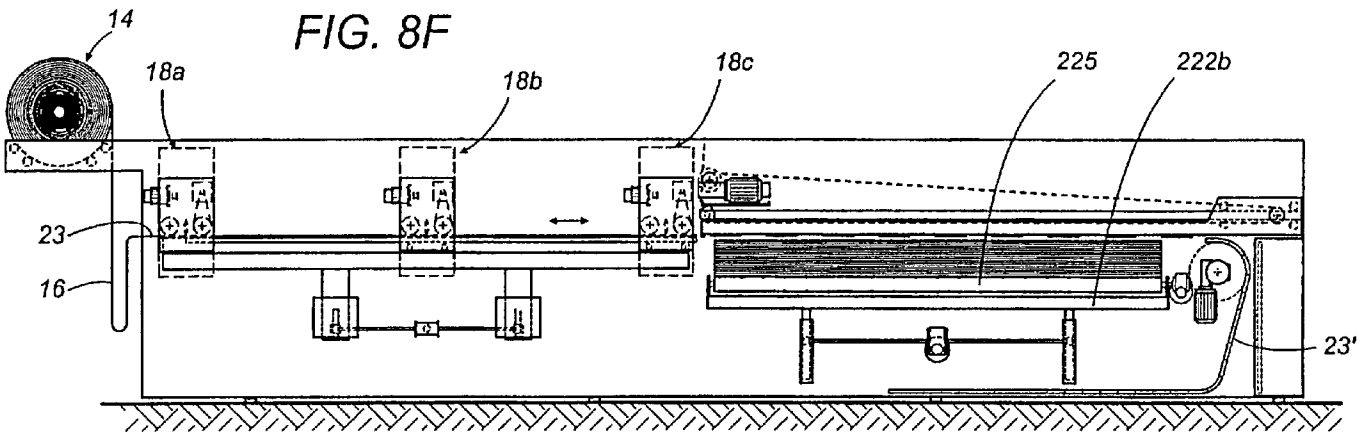

By appropriately setting in rotation said motor means 23'*c*, it is possible to move, as shown by the arrow in FIG. 8E, the aforesaid longitudinally flexible planar element between the position for receiving and supporting the cut pieces, shown in FIG. 8A, and the position in which said planar element 23' extends into a position underlying receiving and offloading means 225, as shown in the successive FIG. 8F.

This movement of the longitudinally flexible or articulated element 23' between said receiving and supporting position and the position for completely transferring the piece to the underlying offloading plane 225, takes place in a gradual manner so that the piece can fall progressively and softly onto the underlying plane 225 or on the upper face of a corresponding piece.

The aforementioned longitudinally articulated planar element is advantageously constituted by a plurality of transverse strips 23" which are mutually connected to each other, in such a way that each strip is hinged or articulated to the immediately adjacent strips along the respective mutual coupling transverse edges 23"*a*. This hinge-like connection between said transverse strips 23" is not explicitly shown in the accompanying figures. In this way, strips 23" are obtained which can be made to rotate relative to the adjacent strips and allow the roller shutter-like plane 23' to assume a curved shape, suitable for positioning in extremely reduced spaces within the size of the machine.

Figure 10:
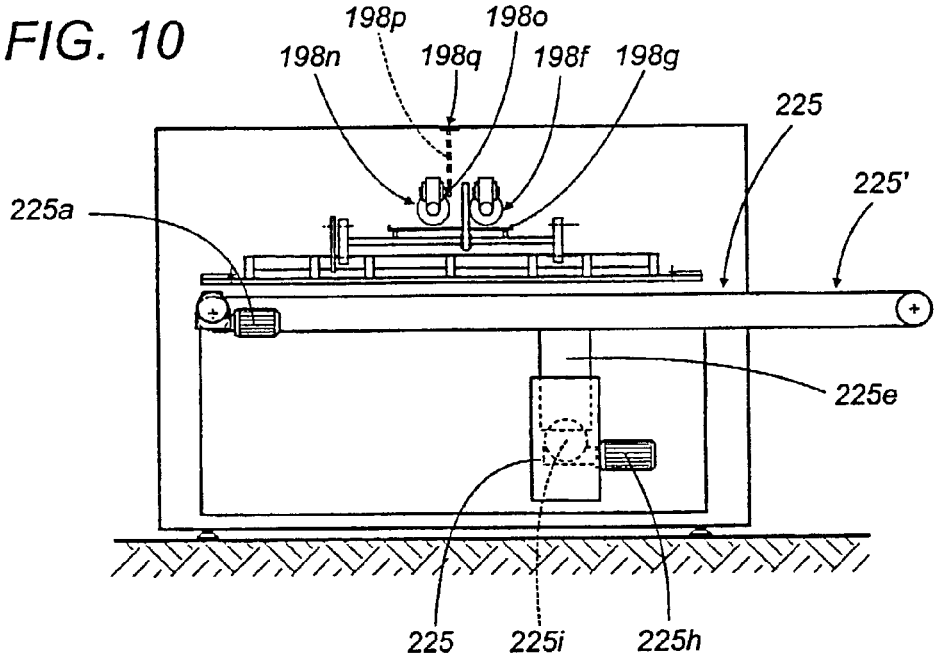
FIG. 10 shows a schematic transverse view of the second preferred embodiment of the present apparatus.

With particular reference to FIGS. 8A and 10, a belt 225 for the accumulation and offloading of the cut material is provided in correspondence with the area S downstream of the cutting area. Said belt 225 is positioned underneath the movable roller shutter-like plane 23', wherefrom it receives the cut material, and extends transverse to the machine to offload said material laterally thereto.

The transverse belt 225 is actuated by means of a corresponding motor 225*a* which is supported, together with the belt itself, on an appropriate frame 225*b*.

As shown in particular in FIG. 10, said transverse advance belt 225 has an end 225' which extends laterally, beyond the transverse profile of the machine, in order to define a projecting support portion or surface for easy withdrawal.

The electronic control and command means of the present machine activate the advance of said transverse belt 225, so that it presents the supported stacked material in correspondence with the projecting area or portion, in order to allow the removal of the material. The advancing motion of the belt 225 is such as to allow an easy withdrawal of the portions of cut material by personnel, for instance it can be effected in steps comprising stopped phases during the withdrawal by assigned personnel and phases for advancing and presenting the additional cut portions of material in correspondence with the projecting transfer area.

Means are provided for adjusting the height of said means 225 for receiving and offloading the cut pieces, in order to obtain an optimal height of fall for said pieces. In practice such means allow to lower the belt 225 as the pieces accumulate one on top of the other. The height of fall remains minimal during the entire process of formation of the stack. Once the belt is offloaded from the stack of cut material present thereon, said belt is raised and placed in the starting position situated just underneath the support plane 23.

The means for varying the height of the upper support plane 225*c* of the belt 225 comprise respective rack means 225*d* integral with vertical struts 225*e* of the frame 225*b* for supporting said conveyor belt 225. To said racks 225*d* are coupled corresponding gears or gear wheels 225*f*, which are connected to respective shafts or rods 225*g* driven in simultaneous rotation by a shared motor 225*h*, by means of a corresponding transmission device 225*i*. The rotation of the gear wheels 225*f* causes the vertical motion, thanks to the racks 225*d*, of the struts 225*e* relative to the fixed columns of the frame 225*b*. The reference number 225*l* in said FIGS. 8*a* and 10 indicates fixed columns for guiding the vertical struts 225*e*.

Appropriate means are provided for transferring the cut pieces from the cutting area T to the storage area S.

Said transfer means are in the form of means for driving the pieces on said bearing planes 22' and 23'.

Figure 9:
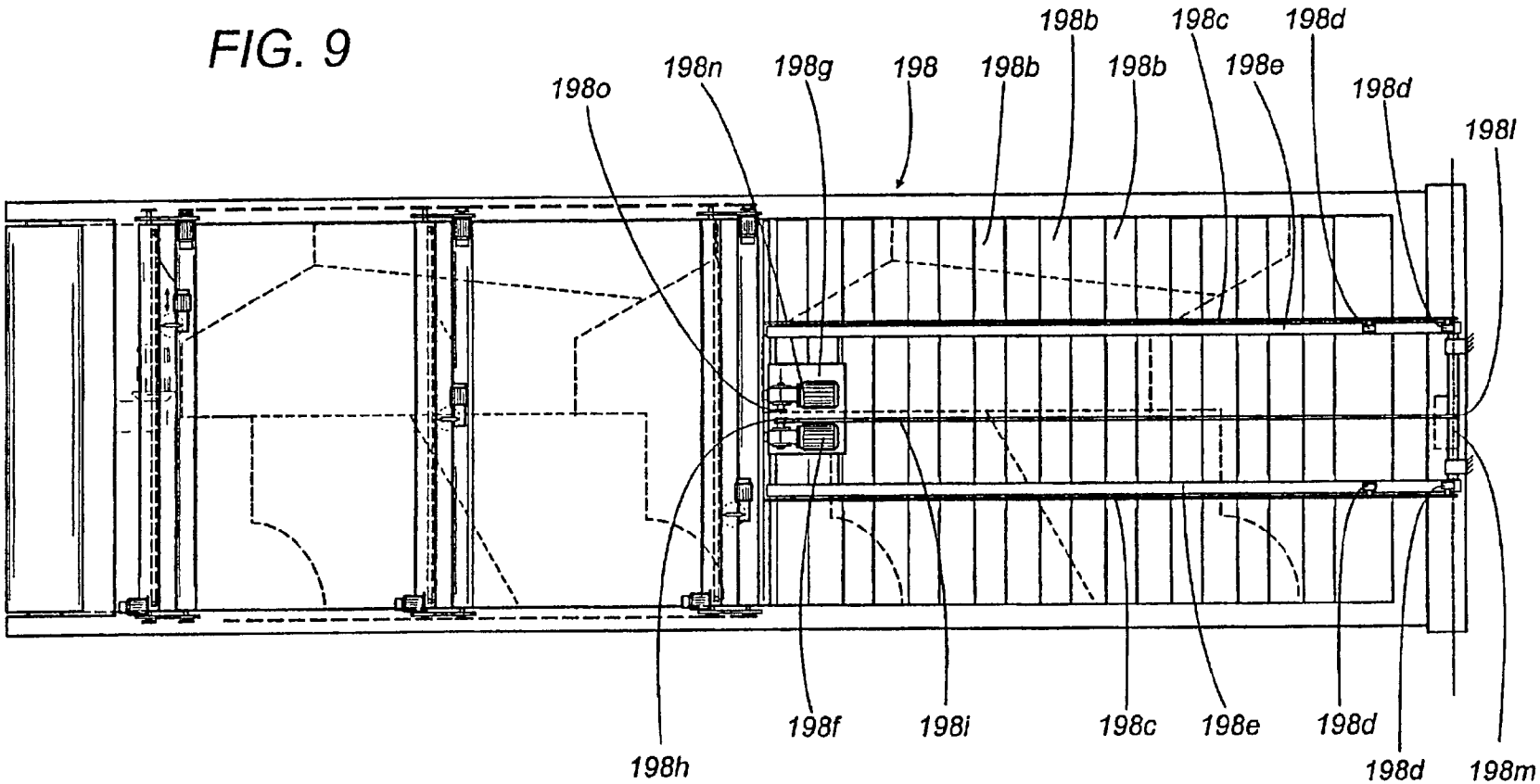
FIG. 9 shows a schematic top plan view of the second preferred embodiment of the present apparatus.
Figure 12:
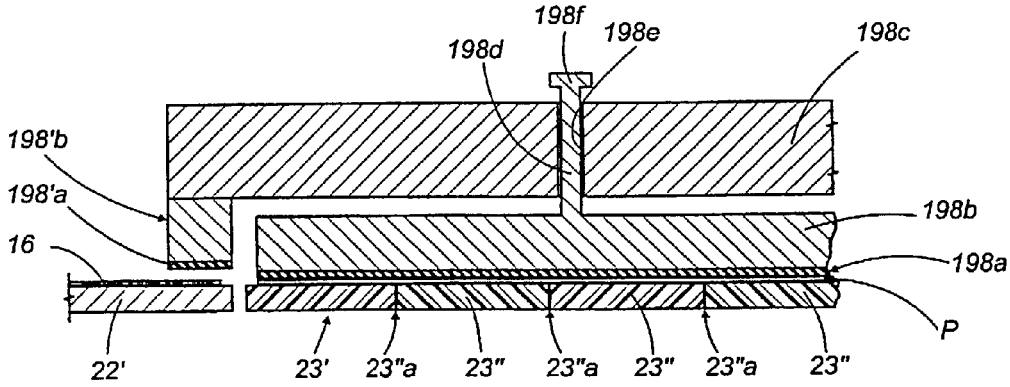
FIG. 12 shows a schematic section view of a detail relating to the movable connection between the engagement means and the support spars of the second preferred embodiment of the present apparatus.

The transfer means are in the form of means for driving the material and comprise, as shown in the successive FIGS. 8C, 9 and 12, means 198 for engaging said pieces and means for actuating said engagement means between said cutting are T and said storage area S.

The engagement means 198 comprise a plurality of surfaces 198*a* extending transversely and longitudinally distanced from each other, in such a way as to be able to engage in a homogeneous and complete manner the various portions of the cut piece to be driven.

These engagement surfaces 198*a* are provided in correspondence with the lower face of corresponding transverse elements 198*b* supported by a first and a second spar 198*c*, 198*c* extending longitudinally.

Advantageously, said engagement surfaces 198*a* are made of such material as to present relative to the material to be treated, a greater friction coefficient that the one presented by said bearing planes 22' and 23'. Said engagement surfaces 198*a* can, for instance, be made of rubber or the like, in order to provide an elastic contact of said material, with no risk of causing damages thereto.

The transfer means comprise a first longitudinally fixed part, sustained by the frame of the machine in correspondence with said storage area S, in a position overlying said movable plane 23', and a second longitudinally movable part defined by said spars 198*c* and by the transverse contact or engagement profiles 198*b*.

This second part is movable in the longitudinal direction between an advanced position, suitable for engaging the piece, in the cutting area T, and a rear or recessed position above the movable bearing plane 23', or of the accumulation area S.

As FIG. 8B clearly shows, the spars 198*c* are able to slide on a respective longitudinal track 198*e* of the longitudinally fixed part, which is engaged in a sliding manner on opposite sides by respective rollers 198*d* provided in correspondence with an enlargement or extreme segment having greater height 198'*d* of the corresponding spar 198*c*.

As shown in the aforementioned FIG. 8B, in the advanced position said means for engaging the cut material extend into the vertical space between said material and the cutting units 18*a*, 18*b*, 18*c*, in raised position.

Appropriate actuation means, in the form of a motor 198*f*, are supported on a horizontal plate 198*g*, provided in correspondence with a rear end of the fixed part and actuate a pulley or the like 198*h*, which is able to command the rotation of a belt 198*i*, or other continuous element extending longitudinally, which is transmitted from a corresponding forward pulley 198*l* of the fixed part.

The longitudinally movable part is suitably fastened (not expressly shown in the accompanying figures) to said longitudinal belt 198*i*, so that, by commanding the rotation of the belt through the motor 198*f*, the advance and, respectively, the backward motion of said longitudinally movable part is obtained.

The forward pulley means 198*l* are coaxially supported by a shaft or rod 198*m*, which is connected to the frame of the machine in such a way as to be able to rotate by a certain angle. A second motor 198*n* is supported on said horizontal plate 198*g* and actuates the rotation of a respective gear wheel or the like 198*o*. A short chain, or corresponding flexible continuous element 198*p* (clearly shown in FIG. 10), has an end fastened to said gear wheel 198*o*, whilst the other end is superiorly fastened, in 198*q*, to the frame of the machine. By commanding, through said motor means 198*n*, the rotation of said wheel 198*o* in an angular direction or in the opposite direction, by a respective and predefined angle, it is possible to wind and, respectively, unwind said short chain 198*p* on said gear wheel defining means for raising and, respectively, lowering the means for engaging the material.

In practice, the means for vertically actuating the portions for engaging and driving the material provide for said actuation by causing the rotation of said longitudinally movable part bearing the means for engaging the material, together with the first part longitudinally fastened relative to the front transverse rod 198*m*. Through this raising and lowering rotation, the vertical motion is obtained of the lateral guides 198*e*, together with the horizontal plate 198*g* and the motors set down thereon, and of the movable longitudinal part connected thereto.

In practice, said longitudinally movable means are inserted in raised position between the lower surface of said cutting units and the underlying material, as shown in FIG. 8B, and are then lowered, as shown in FIG. 8C, in contact with the material, to be then returned backwards with the opposite rotation of said driving belt forward and backward, in such a way as to slide said cut pieces on the respective bearing planes.

As shown in particular in FIG. 12, a strip or transverse element 198'*b*, provided in correspondence with the free end of said spars 198*c*, defines a surface 198'*a* or engagement means of the front portion of the continuous ribbon 16, which allows to slide forward, in correspondence with the cutting area T, new material, unwound from the spool 14, to be successively subjected to cutting.

As said FIG. 12 schematically shows, said transverse elements 198*b* that bear said surfaces 198*a* for engaging the cut material are connected to the respective spars in such a way as to be vertically movable relative thereto. In practice vertical stems 198*d* of said engagement means are inserted and are able to slide in corresponding holes 198*e* of the spars and have an end enlargement 198*f* for retaining to the spar 198*c*, which allows to raise the elements 198*b* in disengagement from the fabric.

In practice, once the new ribbon 16 is positioned in correspondence with the cutting area T, as shown in FIG. 8D, it is possible (as shown by the dashed arrow) slightly to raise the system for sliding the material in such a way as to disengage, as shown in FIG. 12, the end portion 198'*a* of the longitudinally movable means from the front end of said ribbon 16. In the meantime, the vertical sliding, by effect of gravity, of the transverse elements 198*c* relative to said spars allows to keep engaged the cut portions (indicated in FIG. 12 with the reference P) to complete, thanks to the additional return, movement of the longitudinally movable portion, the backwards displacement thereof in the storage area S, which brings the apparatus back to the working position shown in FIG. 8A.

In practice, the raising of the continuous ribbon for disengagement is obtained by rotating said gear wheel 198*o*, in opposite direction to that of lowering, according to a predefined angle of rotation, lesser than the previous angle of rotation defining the lowering of the system.

Figure 13:
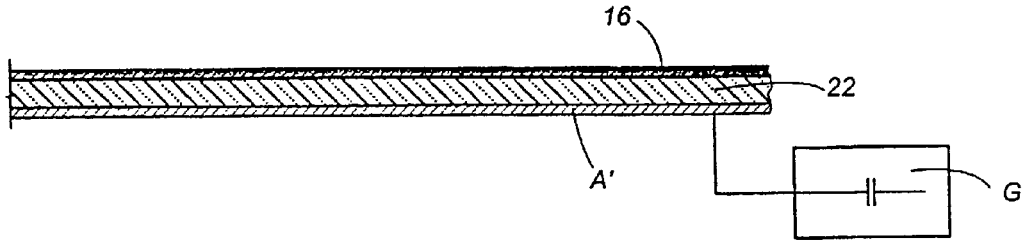
FIG. 13 shows a schematic section view of a detail showing the driving and detachment of the fabric.

As shown in the successive FIG. 13, relating to a further embodiment of the present invention, means for retaining the fabric to the support plane are used, which act in a distributed manner on the surface of said plane 22.

The distributed retention means, which can act on the entire surface of the support plane 22 or in correspondence with predetermined areas thereof, are preferably embodied, if a plane 22 for supporting and contrasting the fabric is used which is made of glass or other dielectric material, by means able to induce an electrical charge on the outer surface of the support plane 22 for said fabric.

In particular, the use is preferred of a metal plate A', which extends underneath the support plane 22 or in any case on the side opposite to the retention plane of said fabric, which plate A' is made of a suitable conducting material and is electrically connected to appropriate means for generating electromotive force or generator G.

The control system for the machine can respectively activate or deactivate said distributed retention means depending on specific requirements.

With the present apparatus it is possible automatically to execute the various work operations, including the phase of offloading the cut material from the cutting area. The apparatus is quiet and avoids the use of the complex air aspiration systems used according to the prior art, which, in addition to being very noisy, cause an annoying heating of the air of the work space where the apparatus is housed and a movement of dusts or the like which risk to be deposited onto the material to be treated.

Moreover, the present apparatus is provided with particularly reduced size, for instance the machine of the second illustrated embodiment can have a length of 8 meters and a width of 2.2 meters.

With the present apparatus, personnel employment is minimised, since in practice it requires only the presence of monitoring personnel and, possibly, of personnel assigned to offload the cut and accumulated stacks of pieces.

In particular, one can observe that the present apparatus allows to execute, advantageously, the stacking and offloading phases simultaneously with the cutting operations on a successive piece.

The invention thus conceived can be subject to numerous modifications and variations, without thereby departing from the scope of the inventive concept. Moreover, all components can be replaced by technically equivalent elements.

What is claimed is:

1. An apparatus for cutting a material into appropriately shaped portions, comprising:

a support frame;

means for supporting said material connected to the support frame;

rotatable means for cutting said material, said cutting means and said material being movable relative to each other according to suitable trajectories for the execution of cuts in said material; and means for holding the material still, said means for holding the material still comprise rollers that are rotatable and are movable across said means for supporting the material without rotation while the rollers are pressing the material against said means for supporting the material;

wherein said means for supporting said material comprise a rigid surface that coacts with said cutting means, so that said cutting means cuts in compression, and wherein said means for supporting said material comprise a support plane made of electrically charged glass having appropriate hardness and defining sliding means for the material to be cut.

2. An apparatus as claimed in claim 1, wherein said cutting means are cutting means able to revolve on the material to the be cut, and in that means are provided for the angular orientation of said revolving cutting means relative to the material to be cut.

3. An apparatus as claimed in claim 1, wherein said cutting means are in the form of a circular cutting blade.

4. An apparatus as claimed in claim 1, further comprising at least a unit for cutting the material able to support respective means for cutting said material and able to actuate said cutting means along predefined trajectories relative to the material.

5. An apparatus as claimed in claim 4, characterised in that said cutting unit (18*a*, 18*b*, 18*c*) comprises means for supporting the cutting means (20), in the form of supporting means (24, 26, 28) able to move longitudinally and means (30) for supporting the cutting means (20) which are movable in a transverse direction relative to said longitudinally movable support means (24, 26, 28).

6. An apparatus as claimed in claim 5, characterised in that said means for moving longitudinally (X) said cutting means (20) comprise motor means (82) situated on said longitudinally movable support means.

7. An apparatus as claimed in claim 6, characterised in that said motor means (82) for longitudinally moving (X) said cutting means (20) are supported on a plate (28) opposed to the one (26) in correspondence whereto are supported the motor means (72) for the transverse actuation of the cutting means (20).

8. An apparatus as claimed in claim 6, characterised in that said motor means (82) for longitudinally moving (X) said cutting means (20) drive means (88, 88) for coupling with a corresponding continuous element (90, 90, 90', 90') extending longitudinally, to obtain the longitudinal translation of the cutting means (20).

9. An apparatus as claimed in claim 8, characterised in that said coupling means comprise at least a gear wheel (88) meshing with a corresponding chain (90,90') extending longitudinally.

10. An apparatus as claimed in claim 5, characterised in that said means for transversely moving (Y) said cutting means (20) comprise motor means (72) situated on said longitudinally movable support means.

11. An apparatus as claimed in claim 10, characterised in that said motor means (72) drive a continuous element (78), which continuous element (78) extends transversely and is operatively connected to said transversely movable means (30) to obtain the translation thereof in a transverse direction.

12. An apparatus as claimed in claim 5, characterised in that said means (30) for supporting the transversely movable cutting means (20) comprise a main block (38) for supporting said cutting means (20).

13. An apparatus as claimed in claim 12, characterised in that said main block (38) pivotally supports a shaft (40) that bears the cutting means (20) and whose axis is perpendicular relative to the material to be cut (16) and is able to be angularly oriented.

14. An apparatus as claimed in claim 5, characterised in that said longitudinally movable support means comprise a beam element (24) extending transversely and a first and a second plate (26,28) fastened to said transverse beam element (24) in correspondence with the opposite ends of said beam element (24).

15. An apparatus as claimed in claim 14, characterised in that guiding and sliding means (32, 34) are provided between said transverse beam (24) and a block (38) for supporting the cutting means (20).

16. An apparatus as claimed in claim 15, characterised in that means for orienting said cutting means (20) by rotating them by a predetermined angle comprise a driving shaft (46) actuated in rotation by corresponding motor means (48) situated on said support block (38).

17. An apparatus as claimed in claim 16, characterized in that said support shaft (40) presents an extreme portion (54) for coupling with said cutting means (20), which is provided offset from the axis of said shaft (40) bearing the cutting means (20), in such a way as to position the cutting means (20) aligned to the axis of the support shaft (40).

18. An apparatus as claimed in claim 15, characterised in that said sliding means comprise a first part, longitudinally fixed, which is sustained by the frame of the machine, in correspondence with said storage area (S), and a second part, longitudinally movable relative to the fixed part between an advanced position suitable to the engagement of the piece, in the cutting area (T), and a rear or recessed position in correspondence with said storage area (S).

19. An apparatus as claimed in claim 18, characterised in that actuating means (198*f*) command the rotation of a continuous element extending longitudinally (198*i*) whereto the movable part is fastened in such a way that, commanding the rotation thereof, the advance and, respectively, the backward motion of said longitudinally movable part is obtained.

20. An apparatus as claimed in claim 19, characterised in that said actuation means (198*f*) are supported on a horizontal plate (198*g*) integral with longitudinal elements of said fixed parts defining guiding means for the longitudinally movable part.

21. An apparatus as claimed in claim 18, characterised in that means are provided for raising, and, respectively, lowering said fixed part in the longitudinal direction.

22. An apparatus as claimed in claim 21, characterised in that said means for raising, and respectively lowering said fixed part are able to set in rotation said second longitudinally movable part which bears the means for engaging the material, together with the first part, longitudinally fixed relative to a front transverse bar (198*m*) supporting transmission means for the first continuous longitudinal actuation element.

23. An apparatus as claimed in claim 22, characterised in that said raising and respectively lowering means comprise a short continuous flexible or articulated element (198*p*) having an end fastened to a wheel or the like (199*o*) and the other end superiorly fastened to the frame in such a way that, by actuating the rotation of said wheel (198*o*) by a predefined angle, it is possible to wind, and respectively unwind said short flexible element (198*p*) on said wheel defining means for raising and respectively lowering the means for engaging the material.

24. An apparatus as claimed in claim 18, characterised in that said second part, longitudinally movable relative to the fixed part, comprises beam means (198*c*, 198*c*) extending longitudinally to support said transverse elements (198*b*) which bear said engagement surfaces (198*a*).

25. An apparatus as claimed in claim 24, characterised in that said means for raising and respectively lowering said fixed part comprise second actuation means (198*n*) supported on said horizontal plate (198*g*).

26. An apparatus as claimed in claim 24, characterised in that at least a transverse element (198'*b*) is provided in correspondence with a free end of a movable means (198*c*) and defines means for engaging the front portion of a continuous ribbon.

27. An apparatus as claimed in claim 4, characterised in that means are provided for returning the respective cutting unit (18*a*, 18*b*, 18*c*) to the cutting position.

28. An apparatus as claimed in claim 27, characterised in that said returning means comprise means for raising, translating backwards, and lowering said cutting unit on the material (16).

29. An apparatus as claimed in claim 28, characterised in that said means for raising and lowering the cutting unit (18*a*,18*b*,18*c*) comprise beam means (104) extending longitudinally whereto the cutting unit (18*a*,18*b*,18*c*) is connected in a sliding manner in the longitudinal direction and in a fixed manner in the perpendicular direction and means able to move perpendicularly said beam (104) to cause the lifting and, respectively, the lowering of the cutting unit relative to the material (16).

30. An apparatus as claimed in claim 29, characterised in that said longitudinal beam means (104) are connected to the continuous advance means (90,90) to raise the latter together with the cutting unit (18*a*,18*b*,18*c*).

31. An apparatus as claimed in claim 29, characterised in that said longitudinal beam means (104) define means for guiding the cutting movement of the cutting unit.

32. An apparatus as claimed in claim 1, wherein said cutting means are able to revolve by effect of rolling on said material.

33. An apparatus as claimed in claim 1, wherein said cutting means are able to effect angular orienting movements according to two opposite angular directions.

34. An apparatus as claimed in claim 1, wherein said means for supporting said material define sliding means able to allow the translation of said material.

35. An apparatus as claimed in claim 1, wherein said means for supporting the material are in the form of a planar plate for bearing the material in correspondence with the cutting area.

36. An apparatus as claimed in claim 35, characterised in that said plate (22) is made of hardened steel.

37. An apparatus as claimed in claim 1, wherein downstream and at the level of said surface for bearing the material, there extends a bearing plane for a cut piece of said material.

38. An apparatus as claimed in claim 1 further comprising means for advancing the material.

39. An apparatus as claimed in claim 38, characterised in that said means for advancing the material (16) are such as to advance said material by a predefined segment.

40. An apparatus as claimed in claim 38, characterised in that said means for advancing the material (16) comprise means (96, 98) for retaining the material and means (90, 90) for advancing said retaining means (96, 98).

41. An apparatus as claimed in claim 40, characterised in that said retaining means comprise said rollers engaged on the material and motionless relative thereto to thrust the material against the opposed bearing means relative whereto said material is made to slide longitudinally.

42. An apparatus as claimed in claim 41, characterised in that said longitudinal advance means are in the form of continuous means extending longitudinally (90, 90), whereto said retaining means (96, 98) are connected, and in that means (100) are provided for advancing said continuous longitudinal means (90, 90) to cause the advance of said material (16).

43. An apparatus as claimed in claim 42, characterised in that said means for actuating the longitudinal advance means (90,90) comprise single motor means (100) for transversely opposed first and second continuous longitudinal advance elements (90,90) connected through corresponding transmission organs (110,110) to the respective continuous elements (90,90).

44. An apparatus as claimed in claim 1, wherein said material to be cut is fed in the form of a continuous ribbon.

45. An apparatus as claimed in claim 44 said material (16) is fed in the form of a continuous ribbon from which are separated successive pieces within each of which are provided said useful shaped portions (16*a*), and in that at least one of the transverse lines (T1,T2) delimiting in said ribbon a single piece of material to be cut (16) present a contoured conformation.

46. An apparatus as claimed in claim 1, wherein means are provided for actuating, with a predetermined pressure, said cutting means against the material to be cut.

47. An apparatus as claimed in claim 46, characterised in that said shaft presents a portion (40*a*) that is axially movable relative to a fixed portion (40*b*), actuator means (60) act between said axially movable portion (40*a*) and said support block (38) to actuate said cutting means (20) against the material (16) to be cut.

48. An apparatus as claimed in claim 46, characterised in that means are provided for varying the pressure that said cutting means (20) exert on the material (16).

49. An apparatus as claimed in claim 48, characterised in that said means for varying the pressure that said cutting means (20) exert on the material (16) and/or for moving said cutting means from a lowered position for engaging and cutting said material (16) and a raised position for disengaging from said material (16) are in the form of means for varying the pressure of a pressurised fluid for driving an actuator (60) acting between said axially movable portion (40*a*) and said support block (38).

50. An apparatus as claimed in claim 49, characterised in that elastic means (66) act to thrust, normally, an axially movable portion (40*a*) of said shaft (10) supporting the cutting means (20) opposing the thrusting action exerted by said actuator (60).

51. An apparatus as claimed in claim 49, characterised in that said actuator (60) comprises a compression chamber (62) obtained within the support block (38) and a thrust piston (64) fastened to said axially movable portion (40*a*) of the shaft (40) that bears the cutting means (20).

52. An apparatus as claimed in claim 1, wherein means are provided for moving said cutting means between a lowered position for engaging and cutting said material and a raised position for disengaging from said material to allow the free movement of the cutting means relative to said material.

53. An apparatus as claimed in claim 1, wherein means are provided for weakening the material in correspondence with the contact between the cutting means and the material to be cut.

54. An apparatus as claimed in claim 53, characterised in that said weakening means are in the form of means for heating the material (16).

55. An apparatus as claimed in claim 53, characterised in that said weakening means are in the form of means able to render the material (16) fragile.

56. An apparatus as claimed in claim 53, characterised in that said weakening means are able to set the material (16) in mechanical vibration.

57. An apparatus as claimed in claim 53, characterised in that said weakening means (120) are means able to set in molecular vibration molecules constituting said material (16).

58. An apparatus as claimed in claim 53, characterised in that said weakening means (120) are preferably selected in the group comprising a direct electrical current, ultrasounds, high and medium frequency electrical currents.

59. An apparatus as claimed in claim 53, characterised in that the means (120) able to weaken the material are sent on said material through said cutting means (20).

60. An apparatus as claimed in claim 53, characterised in that said weakening means (120) are operatively connected between said cutting means (20) and said support plate (22).

61. An apparatus as claimed in claim 1, further comprising a plurality of cutting units in correspondence with a cutting area, each unit being for cutting a respective area of said material.

62. An apparatus as claimed in claim 61, characterised in that said cutting area involved by specific cutting means (18*a*,18*b*,18*c*) is a longitudinal portion of said piece of material.

63. An apparatus as claimed in claim 1, further comprising, on said frame, means for storing the material.

64. An apparatus as claimed in claim 63, characterised in that said means for storing the cut pieces of material is provided above said cutting area (T).

65. An apparatus as claimed in claim 63, characterised in that it comprises means for removing and transferring the cut material (16).

66. An apparatus as claimed in claim 65, characterised in that said removing and transferring means comprise means for gripping the cut piece in correspondence with the transfer area (S) in the form of a bearing plane (23) normally situated in said transfer area (S) whereon said cut pieces carried, means (126) for gripping said bearing plane (23) and means for actuating said means for gripping said bearing plane (23).

67. An apparatus as claimed in claim 66, characterised in that means are provided for transferring the cut piece from said gripping means (126) to the stack or the plane supporting said storage means (125).

68. An apparatus as claimed in claim 67, characterised in that said transfer means comprise a checking surface (136) perpendicularly movable to thrust the piece against an opposed surface of a piece of the stack (123) or of the plane for bearing the storage means (125) and allow the extraction of the movable transfer bearing plane (23).

69. An apparatus as claimed in claim 65, characterised in that said means for transferring the cut pieces from the cutting area (T) to the downstream storage area (S) comprise means for gripping and sliding the material inserting themselves underneath each cutting unit in the raised condition.

70. An apparatus as claimed in claim 69, characterised in that said means for sliding the material comprise means (198) for engaging said material and means for actuating said engaging means between said cutting area (T) and said storage area (S).

71. An apparatus as claimed in claim 70, characterised in that said means (198) for engaging the material in the cut condition comprise a plurality of surfaces (198*a*) extending transversely and longitudinally distanced from each other.

72. An apparatus as claimed in claim 71, characterised in that the surface for engaging the material (198*a*) of said engaging means is made of such a material as to have, relative to the material to be treated, a friction coefficient exceeding the one presented by the bearing surface of said material (23, 23').

73. An apparatus as claimed in claim 71, characterised in that the surface for engaging the material (198*a*) of said engaging means is made of elastic material.

74. An apparatus according to claim 71, characterised in that said engaging surfaces (198*a*) are provided in correspondence with the lower face of corresponding transverse elements (198*b*).

75. An apparatus as claimed in claim 74, characterised in that said transverse elements (198*b*) which bear said surfaces (198*a*) for engaging the cut material are connected to the respective spars in such a way as to be movable vertically relative thereto, and to allow, once the ribbon is positioned in correspondence with the cutting area (T), slightly to raise the system in such a way as to disengage the extreme portion (198'*a*) of the longitudinally movable means from the front end of said ribbon, whilst the vertical sliding, by effect of gravity, of the transverse elements (198*c*) relative to said spars allows to maintain engaged the cut portions to complete the displacement of the material in cut condition in correspondence with the storage area (S).

76. An apparatus as claimed in claim 75, characterised in that said disengagement raising of the continuous ribbon is obtained by rotating a gear wheel (198*o*) in a direction opposite to the direction of lowering, according to a predefined angle of rotation, lesser than the previous angle of rotation defining the lowering of the system.

77. An apparatus as claimed in claim 1, further comprising means for retaining the material to said means for supporting the material which act in distributed fashion on the surface of said supporting means, said distributed retention means being means able to induce an electrical charge on the surface of said means for supporting said material.

78. An apparatus as claimed in claim 1, further comprising means able to move said cutting unit in the vertical direction between a lowered position, for engaging and cutting the material, and a raised position that allows to drive the cut piece towards a downstream storage and offloading area.

79. An apparatus as claimed in claim 1, wherein means are provided for controlling the operation of the present apparatus.

80. An apparatus as claimed in claim 79, characterised in that said control means (MC) comprise electronic processing means operating according to a pre-set work program.

81. An apparatus as claimed in claim 1, further comprising a movable support plane, in correspondence with a storage area downstream of a cutting area, which is defined by a two-dimensional body, flexible or able to fold according to the longitudinal direction and which is moved between a horizontal laying position for receiving the cut material and a retracted position which allows the fall of said material in the cut condition.

82. An apparatus as claimed in claim 81, characterised in that said movable support plane (23') in the retracted position lets said material fall onto corresponding means for supporting and offloading the material.

83. An apparatus according to claim 82, characterised in that said supporting and offloading means comprise an underlying transverse belt (225) which presents an end that extends laterally, beyond the transverse profile of the machine, in order to define a projecting support portion or surface for transferring the material.

84. An apparatus as claimed in claim 82, characterised in that said movable plane (23') extends in said retracted position which allows the fall of said material in the cut condition, in a position underlying receiving and offloading means (225).

85. An apparatus as claimed in claim 84, characterised in that means are provided for adjusting the height of said means (225) for receiving and offloading the cut material.

86. An apparatus as claimed in any of the previous claims 8 through 85, characterised in that it comprises meshing means (90',90'), fixed in the longitudinal direction for corresponding gears (87,88) of the cutting units in order to allow the longitudinal motion of said cutting units.

87. An apparatus as claimed in claim 86, characterised in that said fixed meshing means comprise a respective portion of chain (90',90') extending longitudinally.

88. The apparatus as claimed in claim 1, wherein said material is a fabric and said shaped portions are manufacturable into clothing items.

89. An apparatus as claimed in claim 1, wherein said material to be cut is in the form of a single layer (16) of material.

* * * * *